US010858935B2

(12) United States Patent
Gisolf et al.

(10) Patent No.: US 10,858,935 B2
(45) Date of Patent: Dec. 8, 2020

(54) FLOW REGIME IDENTIFICATION WITH FILTRATE CONTAMINATION MONITORING

(71) Applicant: Schlumberger Technology Corporation, Sugar Land, TX (US)

(72) Inventors: Adriaan Gisolf, Houston, TX (US); Youxiang Zuo, Sugar Land, TX (US); Ryan Sangjun Lee, Sugar Land, TX (US); Jonathan Leonard, Phoenix, AZ (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 831 days.

(21) Appl. No.: 14/164,991

(22) Filed: Jan. 27, 2014

(65) Prior Publication Data

US 2015/0211361 A1 Jul. 30, 2015

(51) Int. Cl.
*E21B 49/08* (2006.01)

(52) U.S. Cl.
CPC ..... *E21B 49/08* (2013.01); *E21B 49/0875* (2020.05)

(58) Field of Classification Search
CPC ..... E21B 49/08; E21B 2049/085
See application file for complete search history.

(56) References Cited

U.S. PATENT DOCUMENTS 6,729,400 B2 5/2004 Mullins et al.
6,956,204 B2 10/2005 Dong et al.
7,028,773 B2 4/2006 Fujisawa et al.
7,372,264 B2 * 5/2008 Akkurt ..... E21B 49/08 324/300
7,920,970 B2 4/2011 Zuo et al.
8,024,125 B2 9/2011 Hsu et al.
8,201,625 B2 6/2012 Almaguer
9,733,389 B2 * 8/2017 Hsu ..... G01V 11/00
2003/0220775 A1 11/2003 Jourdan et al.
2004/0193375 A1 * 9/2004 Dong ..... E21B 47/10 702/13
2005/0182566 A1 8/2005 DiFoggio
2005/0216196 A1 * 9/2005 Akkurt ..... G01N 24/081 702/6

(Continued)

FOREIGN PATENT DOCUMENTS

GB 2419424 A 4/2006
WO 2008104750 A1 9/2008

(Continued)

OTHER PUBLICATIONS

Search and Examination Report issued in related GB application GB1501318.8 dated Jun. 11, 2015, 7 pages.

(Continued)

*Primary Examiner* — Lina M Cordero
(74) *Attorney, Agent, or Firm* — Trevor G. Grove

(57) ABSTRACT

Implementations of the present disclosure relate to apparatuses, systems, and methods for determining when a well cleanup process has established developed flow and then extrapolating out modeled fluid parameter values to determine parameter values for a formation fluid. The model fluid parameter values may be modeled using a power law function having a specified exponent value.

15 Claims, 16 Drawing Sheets

(56) References Cited

U.S. PATENT DOCUMENTS

| | | | | |
|---|---|---|---|---|
| 2006/0155474 | A1* | 7/2006 | Venkataramanan | E21B 49/00 702/13 |
| 2006/0241866 | A1* | 10/2006 | DiFoggio | E21B 47/102 702/12 |
| 2006/0250130 | A1* | 11/2006 | Akkurt | E21B 49/08 324/303 |
| 2007/0079962 | A1 | 4/2007 | Lazovsky et al. | |
| 2008/0073078 | A1* | 3/2008 | Sherwood | E21B 49/10 166/264 |
| 2008/0125973 | A1* | 5/2008 | Sherwood | E21B 49/10 702/11 |
| 2008/0156088 | A1* | 7/2008 | Hsu | E21B 49/10 73/152.23 |
| 2009/0166085 | A1* | 7/2009 | Ciglenec | E21B 49/08 175/24 |
| 2010/0175873 | A1 | 7/2010 | Milkovisch et al. | |
| 2010/0294491 | A1* | 11/2010 | Zazovsky | E21B 49/087 166/250.01 |
| 2012/0053838 | A1 | 3/2012 | Andrews et al. | |
| 2013/0311099 | A1* | 11/2013 | Eyuboglu | E21B 49/08 702/11 |
| 2014/0180591 | A1 | 6/2014 | Hsu et al. | |
| 2014/0316705 | A1 | 10/2014 | Zuo et al. | |
| 2015/0135814 | A1 | 5/2015 | Zuo et al. | |
| 2015/0142317 | A1 | 5/2015 | Zuo et al. | |
| 2015/0211361 | A1 | 7/2015 | Gisolf et al. | |
| 2015/0226059 | A1 | 8/2015 | Zuo et al. | |
| 2015/0292324 | A1 | 10/2015 | Jackson et al. | |
| 2015/0308261 | A1 | 10/2015 | Zuo et al. | |
| 2015/0308264 | A1 | 10/2015 | Zuo et al. | |
| 2016/0061743 | A1 | 3/2016 | Wang et al. | |
| 2016/0130940 | A1 | 5/2016 | Hsu et al. | |

FOREIGN PATENT DOCUMENTS

| | | | |
|---|---|---|---|
| WO | 2010062635 | A2 | 6/2010 |
| WO | 2011138700 | A2 | 11/2011 |

OTHER PUBLICATIONS

Kristensen et al. "Flow Modeling and Comparative Analysis for a New Generation of Wireline Formation Tester Modules," IPTC 17385, International Petroleum Technology Conference, Doha, Qatar, Jan. 20-22, 2014, pp. 1-14.

Zuo, et al. "A New Method for OBM Decontamination in Downhole Fluid Analysis", IPTC 16524, International Petroleum Technology Conference, Beijing, China, Mar. 26-28, 2013, pp. 1-8.

U.S. Appl. No. 14/085,550, filed Nov. 20, 2013.

U.S. Appl. No. 14/085,589, filed Nov. 20, 2013.

U.S. Appl. No. 13/865,839, filed Apr. 18, 2013.

U.S. Appl. No. 13/721,981, filed Dec. 20, 2012.

Sherwood, D.J. "Fluid Smapling from Porous Rock to Determine Filtrate Contamination Profiles around a Well Bore", Transp Porous Med (2010) 81: 479-503.

Examination Report issued in the related GB Application No. GB1501318.8, dated Mar. 7, 2016 (2 pages).

Dong, C., et al., "Focused Formation Fluid Sampling Method", Mar. 1, 2006, dowloaded from url: http://www.offshore-mag.com/articles/print/volume-66/issue-3/drilling-completion/focused-formation-fluid-sampling-method.html, on Sep. 5, 2017 (7 pages).

Nguyen, T., "Dilling Engineering—PE311 Chapter 2: Dilling Fluids Introduction to Drilling Fluids", New Mexico Tech., Fall 2012 (40 pages).

Office Action issued in the related U.S. Appl. No. 14/867,262, dated Aug. 27, 2018 (36 pages).

* cited by examiner

FLOW REGIME IDENTIFICATION WITH FILTRATE CONTAMINATION MONITORING

CROSS-REFERENCE TO RELATED APPLICATIONS

N/A

BACKGROUND OF THE DISCLOSURE

Wells can be drilled into a surface location or ocean bed to access fluids, such as liquid and gaseous hydrocarbons, stored in subterranean formations. The formations through which the well passes can be evaluated for a variety of properties, including but not limited to the presence of hydrocarbon reservoirs in the formation. Wells may be drilled using a drill bit attached to the end of a "drill string," which includes a drillpipe, a bottomhole assembly, and additional components that facilitate rotation of the drill bit to create a borehole. During the drilling process, drilling fluid, commonly referred to as "mud," is pumped through the drill string to the drill bit. The drilling fluid provides lubrication and cooling to the drill bit during the drilling operation, as well as evacuating any drill cuttings to the surface through an annular channel between the drill string and borehole wall. Drilling fluid that invades the surrounding formation is commonly known as "filtrate."

It may be desirable to evaluate the subsurface formations through which the borehole passes for oil and gas exploration. Evaluation of the subsurface formation includes, in particular, determining certain properties of the fluids stored in the subsurface formations. When a sample of the fluid in the borehole is collected for evaluation of the subsurface formation, the sample fluid may include formation fluid, filtrate, and/or drilling fluid. As used herein, "formation fluid" refers broadly to any oil and gas naturally stored in the surrounding subsurface formation. The collection of uncontaminated formation fluid may involve drawing fluid into the borehole and/or the downhole tool to establish a cleanup flow and remove the filtrate contaminating the formation fluid.

SUMMARY

In an embodiment, a method for extrapolating a formation fluid parameter in a reservoir is provided. The method may include obtaining a measured data array including at least a sample fluid parameter and a durational value and fitting the measured data array to a model defined by a power law function containing the durational value. The model is extrapolated out according to the power law function to when the durational value equals infinity to find the value of a formation fluid parameter. Although reference is made to the durational value "equaling infinity," the durational value may approach infinity, may approximate late time in the cleanup cycle, or may be substantially equal to infinity. A fitting interval start point is then determined. Confirmation that the interval start point overlays the start of a linear portion of the measured data array when compared on log-log scales may then be obtained.

In another embodiment, a method for extrapolating formation fluid properties from contaminated fluid in a reservoir is presented. The method includes obtaining a measured data array including at least a sample fluid parameter (FP) and a durational value (D). A model is then fit to the measured data array using a power law function. The power law function is defined as $FP=\alpha+\beta*D^{\gamma}$, where the value of $\gamma$ is about $-2/3$. The equation $FP=\alpha+\beta*D^{\gamma}$ is extrapolated to when the durational value equals infinity to find $\alpha$. A fitting interval start may be determined and then confirmed by ensuring the fitting interval start overlays the start of a linear portion of the measured data array when compared on log-log scales. A contamination level is then determined.

In an embodiment, a computer program product is provided for implementing a method of calculating clean fluid properties from contaminated fluid in a system. The computer program product may include a computer-readable storage media that have stored thereon computer-executable instructions that, when executed by a processor of the computing system, cause the computing system to perform the method. The method may include accessing a measured data array including at least a sample fluid parameter and a durational value and fitting a model defined by a power law function containing the durational value to the measured data array. The model is extrapolated out according to the power law function to when the durational value equals infinity to calculate the value of a formation fluid parameter. A fitting interval start point is then determined. Confirmation that the interval start point overlays a start of a linear portion of the measured data array when compared on log-log scales may then be obtained.

Additional features and advantages of exemplary implementations of the disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description will be rendered by reference to specific embodiments thereof which are illustrated in the appended drawings. For better understanding, the like elements have been designated by like reference numbers throughout the various accompanying figures. Understanding that these drawings depict only typical embodiments of the disclosure and are not therefore to be considered to be limiting of its scope, the embodiments will be described and explained with additional specificity and detail through the use of the accompanying drawings in which:

FIGS. 4-1 and 4-2 depict a sensitivity simulation depicting graphs of cleanup rates for formations with a selection of absolute permeabilities;

FIGS. 5-1 and 5-2 depict a sensitivity simulation depicting graphs of cleanup rates for formations with a selection of permeability anisotropies;

FIGS. 6-1 and 6-2 depict a sensitivity simulation depicting graphs of cleanup rates for formations with a selection of viscosity ratios;

FIGS. 7-1 and 7-2 depict a sensitivity simulation depicting graphs of cleanup rates for formations with a selection of filtrate invasion depths;

DETAILED DESCRIPTION

Figure 1:
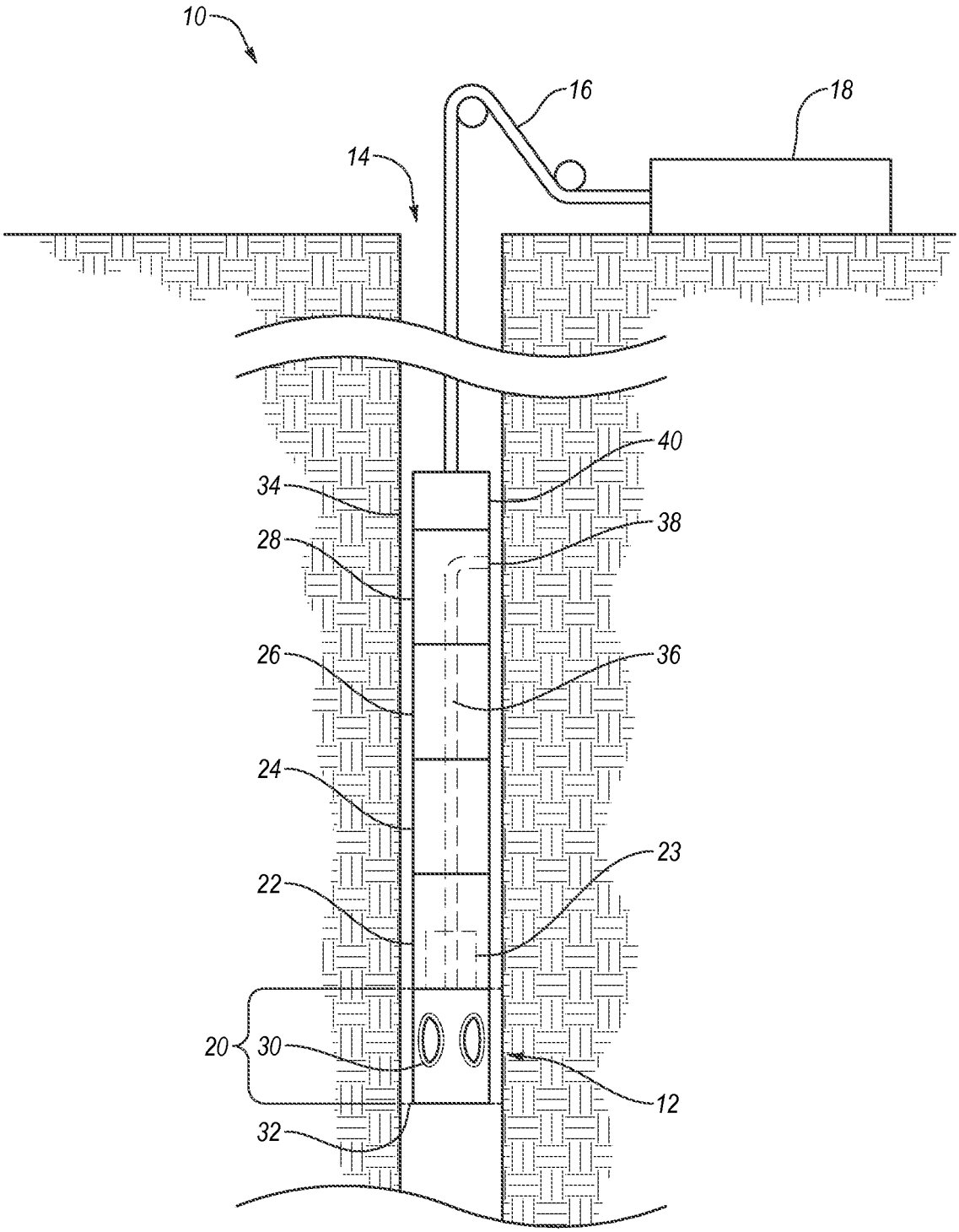
FIG. 1 is a side cross-section view of a well and formation testing system in accordance with one or more embodiments.

One or more specific embodiments of the present disclosure will be described below. These described embodiments are examples of the presently disclosed techniques. Additionally, in an effort to provide a concise description of these embodiments, not all features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

This disclosure generally relates to sampling with formation testers in a downhole tool to capture a fluid sample that is representative of a formation fluid. During oil and gas exploration, the collection of a fluid sample that is representative of the surrounding formation fluid may be desirable to measure and/or evaluate properties of the surrounding formation. A formation fluid is a fluid, gaseous or liquid, that is trapped in a formation, which may be penetrated by a borehole. In many drilling operations, the borehole is drilled using a drilling fluid or "drilling mud" that is pumped down through the drill string and used to lubricate the drill bit. The drilling fluid may be oil-based or water-based. The drilling fluid returns to the surface carrying drill cuttings through an annular channel surrounding the drill string and within the borehole. During drilling, the drilling fluid may penetrate into the surrounding formation and contaminate the fluid stored in the formation near the borehole. Although the embodiments described herein may refer generally to formation testers in a downhole tool, the present disclosure is not limited to application in these environments.

The formation fluid can be drawn into the downhole tool and the contamination level of drilling fluid or mud within the fluid may be monitored. When the contamination level decreases to a desired level, a sample of the fluid may be stored within the downhole tool for retrieval to the surface, where further analysis may occur. Contamination monitoring employs knowledge of virgin formation fluid properties. Once the formation fluid properties are known, mixing rules can be used to determine the contamination of the fluid being pumped at any given time with a formation tester. Power laws are used to model the (change in) formation fluid properties as fluid is pumped from formation. Such models can then be extrapolated to obtain the virgin formation fluid properties. However, the entire fluid clean up cannot be modeled with a single power law. Modeling data of changing power law exponent with a model that contains a fixed power law exponent creates a model mismatch. The techniques described herein provide systems and methods to determine when the cleanup behavior (data) follows a constant power law. The model can now be fitted on the measured data without model mismatch, allowing the virgin formation fluid properties to be obtained after model extrapolation.

FIG. 1 depicts a wireline system 10 in accordance with an embodiment. While certain elements of the wireline system 10 are depicted in this figure and generally discussed below, it will be appreciated that the wireline system 10 may include other components in addition to, or in place of, those presently illustrated and discussed. As depicted, the wireline system 10 includes a sampling tool 12 suspended in a well 14 from a cable 16. The cable 16 may be a wireline cable that may support the sampling tool 12 and may include at least one conductor that enables data communication between the sampling tool 12 and a control and monitoring system 18 disposed on the surface.

The cable 16, and hence the sampling tool 12, may be positioned within the well in any suitable manner. As an example, the cable 16 may be connected to a drum, allowing rotation of the drum to raise and lower the sampling tool 12. The drum may be disposed on a service truck or a stationary platform. The service truck or stationary platform may further contain the control and monitoring system 18. The control and monitoring system 18 may include one or more computer systems or devices and/or may be a distributed computer system. For example, collected data may be stored, distributed, communicated to an operator, and/or processed locally or remotely. The control and monitoring system 18 may, individually or in combination with other system components, perform the methods discussed below, or portions thereof.

The sampling tool 12 may include multiple components. For example, the sampling tool 12 includes a probe module 20, a fluid analysis module 22, a pump module 24, a power module 26, and a fluid sampling module 28. However, in further embodiments, the sampling tool 12 may include additional or fewer components. The probe module 20 of the sampling tool 12 includes one or more inlets 30 that may engage or be positioned adjacent to the wall 34 of the well 14. The one or more inlets 30 may be designed to provide focused or un-focused sampling. Furthermore, the probe module 20 also includes one or more deployable members 32 configured to place the inlets 30 into engagement with the wall 34 of the well 14. For example, as shown in FIG. 1, the deployable member 32 includes an inflatable packer that can be expanded circumferentially around the probe module 20 to extend the inlets 30 into engagement with the wall 34. In another embodiment, the one or more deployable members 32 may be one or more setting pistons that may be extended against one or more points on the wall of the well to urge the inlets 30 against the wall. In yet another embodiment, the inlets 30 may be disposed on one or more extendable probes designed to engage the wall 34.

The pump module 24 draws sample fluid through a flowline 36 that provides fluid communication between the one or more inlets 30 and the outlet 38. As shown in FIG. 1, the flowline 36 extends through the probe module 20 and the fluid analysis module 22 before reaching the pump module 24. However, in other embodiments, the arrangement of the modules 20, 22, and 24 may vary. For example, in certain embodiments, the fluid analysis module 22 may be disposed on the other side of the pump module 24. The flowline 36 also may extend through the power module 26 and the fluid sampling module 28 before reaching the outlet 38. The fluid sampling module 28 may selectively retain some fluid for storage and transport to the surface for further evaluation outside the borehole. The fluid sampling tool may also include a downhole controller 40 that may include one or more computer systems or devices and/or may be part of a distributed computer system. The downhole controller 40 may, individually or in combination with other system components (e.g., control and monitoring system 18), perform the methods discussed below, or portions thereof.

Figure 2:
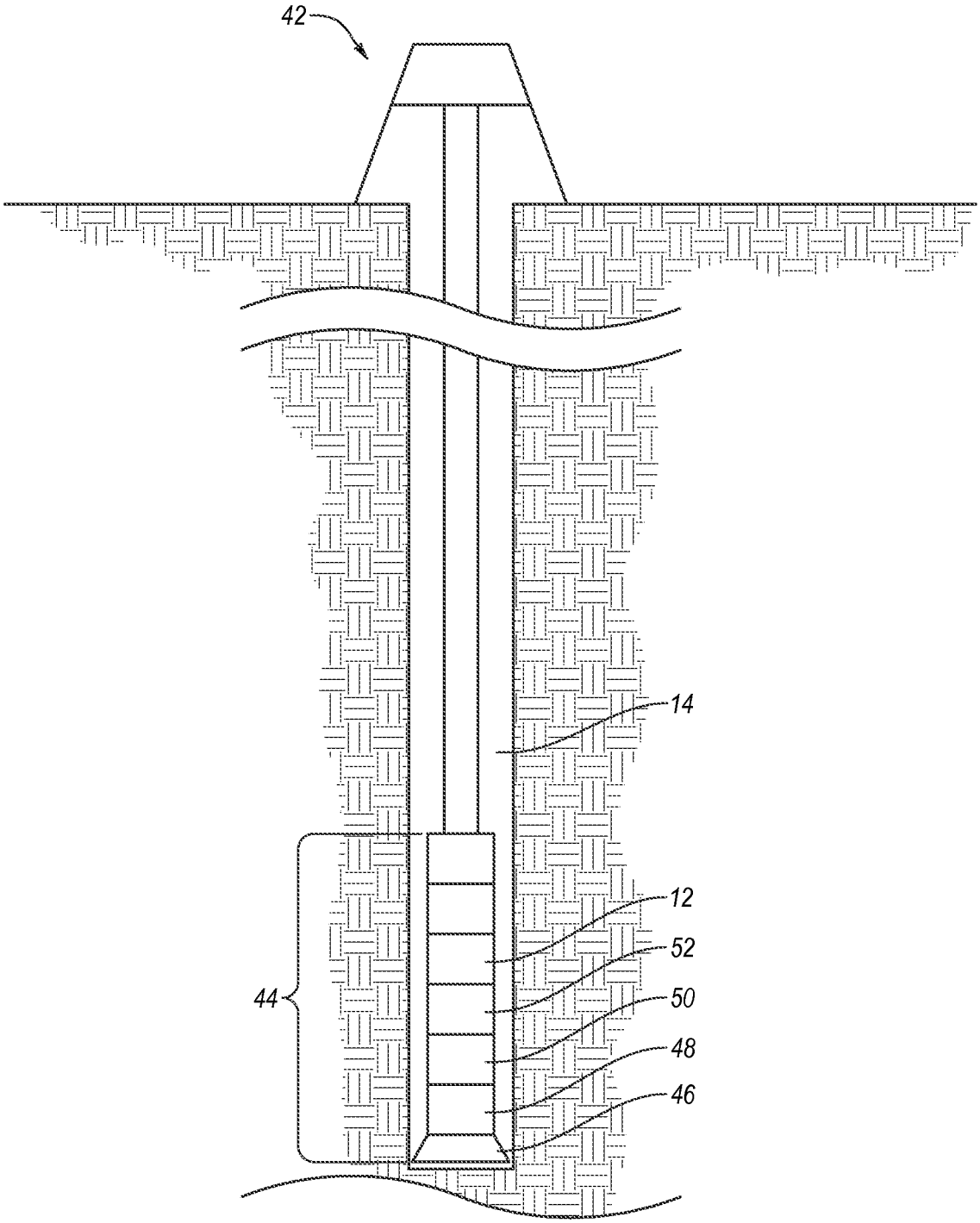
FIG. 2 is a side cross-section view of a well and drill string in accordance with one or more embodiments.

While FIG. 1 illustrates sampling being conducted with a single sample tool 12 in one borehole, it will be appreciated that other embodiments are contemplated. For instance, sampling may be conducted in a single borehole with one or more sampling tools 12 or conducted with one or more sampling tools 12 in each of a plurality of boreholes. Furthermore, while the sampling tool 12 is depicted in FIG. 1 as part of a wireline system, in other embodiments the sampling tool 12 may be a portion of a drilling system 42, as shown in FIG. 2. The drilling system 42 includes a bottomhole assembly 44 that includes data collection modules. For example, in addition to the drill bit 46 and steering module 48 for manipulating the orientation of the drill bit 46, the bottomhole assembly 44 includes a measurement-while-drilling (MWD) module 50 and a logging-while-drilling (LWD) module 52. The MWD module 50 is capable of collecting information about the rock and formation fluid properties within the well 14, and the LWD module 52 is capable of collecting characteristics of the bottomhole assembly 44 and the well 14, such as orientation (azimuth and inclination) of the drill bit 46, torque, shock and vibration, the weight on the drill bit 46, and downhole temperature and pressure. The MWD module 50 may be capable, therefore, of collecting real-time data during drilling that can facilitate formation analysis. Additionally, although depicted in an onshore well 14, wireline system 10 and drilling system 42 could instead be deployed in an offshore well. Further, in yet other embodiments, the sampling tool 12 may be conveyed within a well 14 on other conveyance means, such as wired drill pipe, or coiled tubing, among others.

Referring back to FIG. 1, fluid samples are collected with the sampling tool 12. The sampling tool 12 may be extended to various locations within the well 14 and fluid samples may be collected at those locations. The fluid samples may reflect gradients within a formation or represent the fluids contained within multiple formations through which the borehole penetrates. In order to capture a fluid sample that is representative of the formation fluid, the sampling device may need to pump out a larger volume of fluid than the sample. The pump out volume may, in some cases, be larger than the sample size in order to remove the drilling fluid present immediately surrounding the sampling device in the borehole and the mixed fluid in the surrounding formation containing both the formation fluid and the drilling fluid. The process of removing fluid from the area surrounding the sampling device is referred to as filtrate cleanup and may be used when sampling formation fluid.

Monitoring of the cleanup process can be performed using downhole sensors capable of measuring properties such as optical density, gas-oil ratio, conductivity, density, compressibility, and other properties measurable through downhole fluid analysis ("DFA"). For instance, the fluid analysis module 22 may include a fluid analyzer 23 that can be employed to provide in situ downhole fluid measurements. For example, the fluid analyzer 23 may include a spectrometer and/or a gas analyzer designed to measure properties such as, optical density, fluid density, fluid viscosity, fluid fluorescence, fluid composition, and the fluid gas-oil ratio, among others. According to certain embodiments, the spectrometer may include any suitable number of measurement channels for detecting different wavelengths, and may include a filter-array spectrometer or a grating spectrometer. For example, the spectrometer may be a filter-array absorption spectrometer having ten measurement channels. In other embodiments, the spectrometer may have sixteen channels or twenty channels, and may be provided as a filter-array spectrometer or a grating spectrometer, or a combination thereof (e.g., a dual spectrometer), by way of example. According to certain embodiments, the gas analyzer may include one or more photodetector arrays that detect reflected light rays at certain angles of incidence. The gas analyzer also may include a light source, such as a light emitting diode, a prism, such as a sapphire prism, and a polarizer, among other components. In certain embodiments, the gas analyzer may include a gas detector and one or more fluorescence detectors designed to detect free gas bubbles and retrograde condensate liquid drop out.

One or more additional measurement devices, such as temperature sensors, pressure sensors, viscosity sensors, chemical sensors (e.g., for measuring pH or $H_2S$ levels), and gas chromatographs, may be included within the fluid analyzer. Further, the fluid analyzer 23 may include a resistivity sensor and a density sensor, which, for example, may be a densimeter or a densitometer. In certain embodiments, the fluid analysis module 22 may include a controller, such as a microprocessor or control circuitry, designed to calculate certain fluid properties based on the sensor measurements. Further, in certain embodiments, the controller may govern sampling operations based on the fluid measurements or properties. Moreover, in other embodiments, the controller may be disposed within another module of the downhole tool 12.

The measurements taken during DFA may allow the estimation of contamination ratios using the known properties of the drilling fluid. For example, optical density measurements may be used to determine the ratio of filtrate to formation fluid using a power law function to fit measured data and extrapolate a formation fluid parameter. To determine the power law function to which the data is fit, the removal rate of the contaminating drilling fluid relative to the formation fluid must be known.

Figure 3:
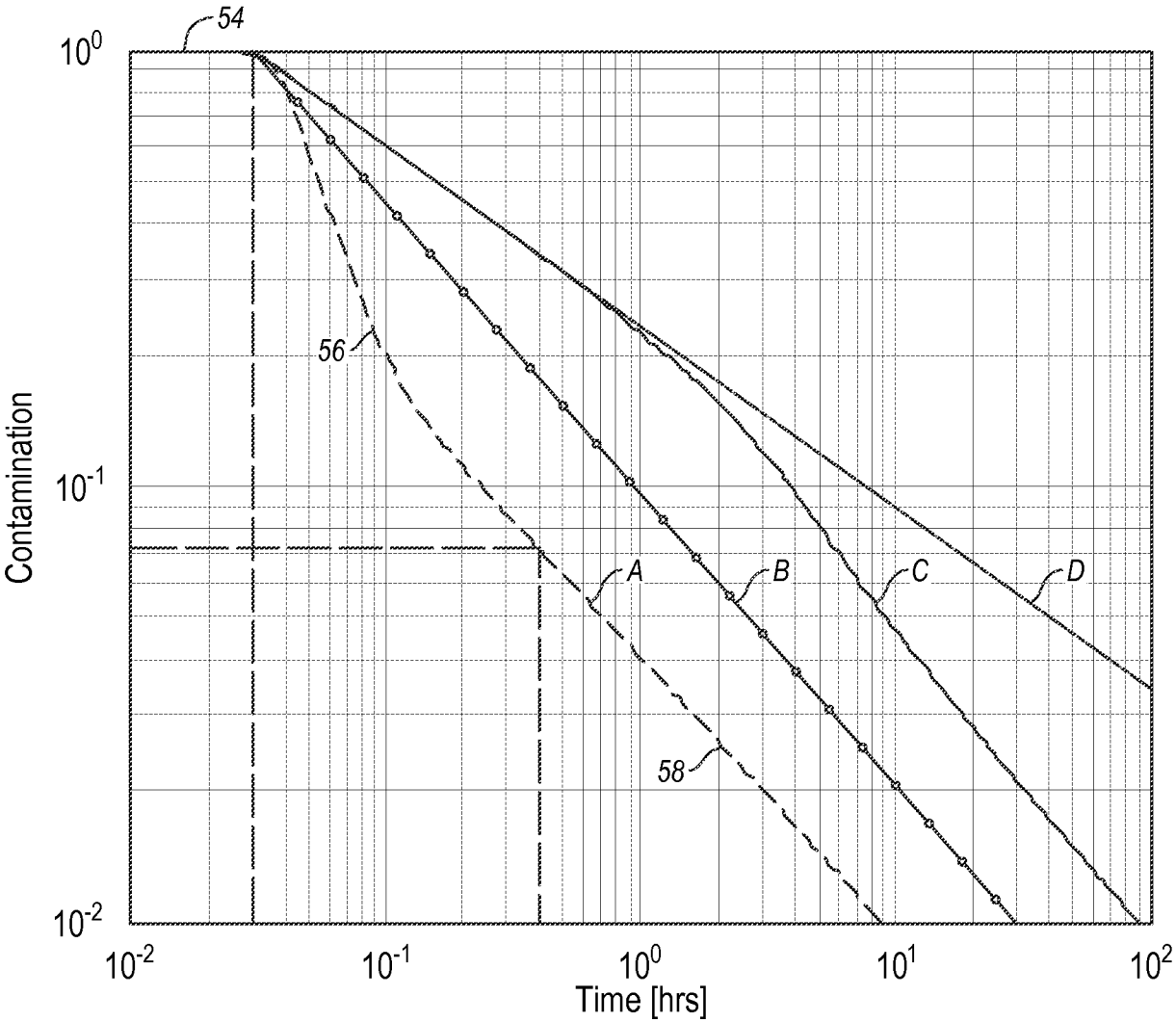
FIG. 3 is a graph depicting contamination clean up rates for different sampling devices.

As shown in FIG. 3, during pump out of the sample fluid, the proportion of drilling fluid in the sample fluid changes in three distinct regimes: a first regime 54 of drilling fluid production, a second regime 56 just after formation fluid breakthrough, and a third regime 58 of developed flow. The first regime 54 relates to the period during which the pump out produces the drilling fluid adjacent the sampling device and drill string, with little or no formation fluid included in the fluid drawn into the downhole tool. This first regime 54 may vary in duration depending on the type of sampling device, borehole size, and pump out rate, among others. The first regime 54 is associated with near 100% drilling fluid content, and therefore is easily characterized by DFA and comparison of measured values against known values of the drilling fluid. When the region of pure drilling fluid in the borehole and immediately surrounding the sampling device has been evacuated, some formation fluid is drawn nearer the sampling device and the ratio of drilling fluid to formation fluid begins to decrease as more formation fluid is drawn into the downhole tool. This period of flow just after formation fluid breakthrough is an intermediate period that defines the second flow regime 56.

The second flow regime 56 correlates to a time of pumping out a high concentration of filtrate from the formation immediately surrounding the section of the borehole containing the sampling tool 12. In some embodiments, in the second flow regime 56, the clean-up rate is proportional to $V^{-5/12}$, where V is a pump-out volume. (Note that the pump-out volume value V may be replaced with a time value t when the pump rate is constant and therefore the time of pumping and volume pumped are correlated.) The contaminant pump out rate may vary in the second flow regime 56 depending on an inlet configuration on the sampling tool 12, as well as the type of sampling tool 12, among others. In certain embodiments, the intermediate second flow regime 56 physically corresponds to circumferential clean-up where filtrate is drawn from around the wellbore circumference at the level of the sampling tool 12 before flow to the sampling tool has been established from the region of the formation above and below the sampling tool 12.

Finally, the third flow regime 58 corresponds to a developed flow of fluid through the formation surrounding the sampling device. In some embodiments, the clean-up rate of the third flow regime 58 corresponds to a $V^{-2/3}$ power law function. Physically, this flow regime corresponds to a situation where all, or most of, the filtrate around the circumference of the wellbore at the level of the sampling device has been removed and filtrate instead flows vertically from above and below the sampling tool 12. The developed flow of the third flow regime 58 may allow measured fluid properties to be extrapolated to clean formation fluid properties using the power law function of the clean-up rate. Line A in FIG. 3 displays the cleanup rate of a radial probe while line B reflects a power law function having a $-2/3$ exponent. A radial probe may comprise one or more inlets disposed circumferentially about the body of the probe. In one embodiment, a radial probe may comprise multiple inlets with the multiple inlets spaced circumferentially around the body of the probe, such as probe 20 illustrated in FIG. 1. In another embodiment, a radial probe may comprise at least one inlet where the at least one inlet extends substantially circumferentially about the body of the probe. In some embodiments, the one or more inlets may be associated with extendable probes. The radial probe establishes the developed flow of the third flow regime 58 after a comparatively short second flow regime 56. Rapid attainment of the third flow regime 58 during use of a radial probe may enable earlier recognition of developed flow. In some embodiments, early recognition of developed flow may allow for earlier application of a cleanup flow model, resulting in reduced time for obtaining a clean formation fluid sample. Line C displays a single port probe and line D correlates to a power law function having a $-5/12$ exponent. Line C follows the behavior of a power law function having a $-5/12$ exponent until developed flow is established and then approximately follows the $-2/3$ exponent of the unfocused probe cleanup rate.

Figures 1, 6:
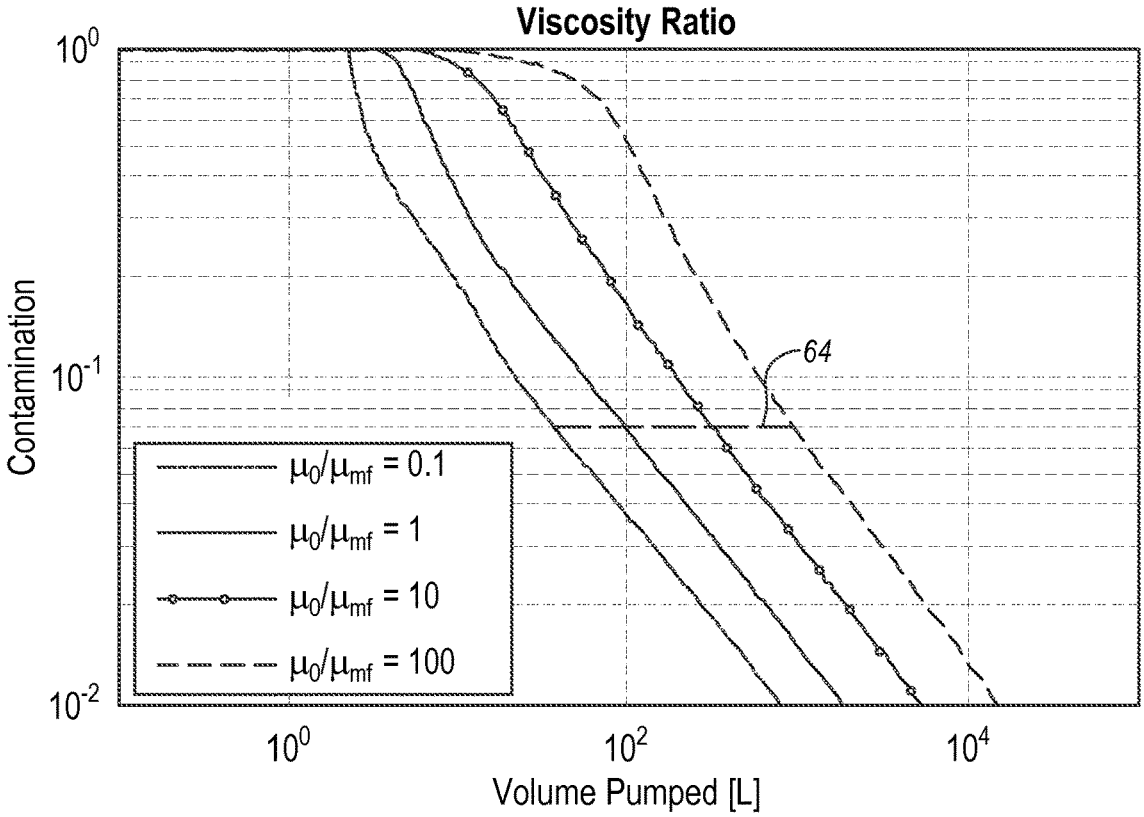
Figures 2, 6:
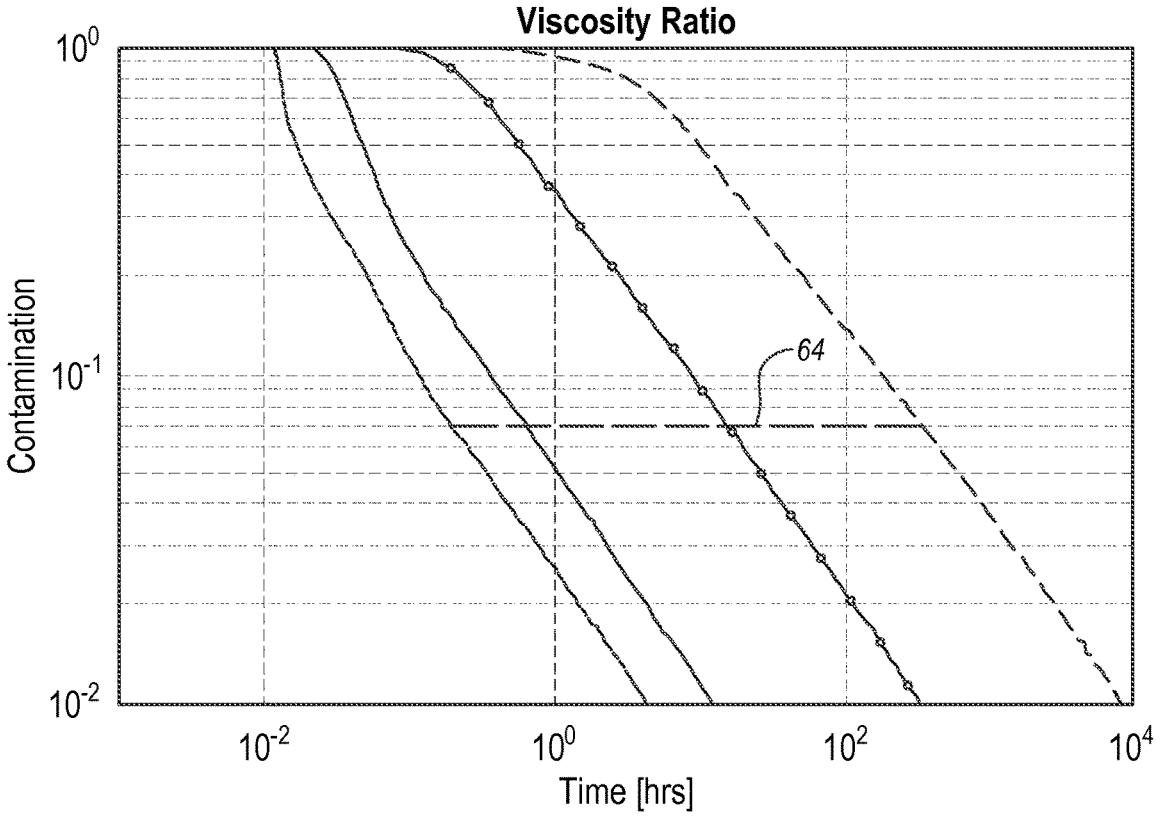
Figures 1, 7:
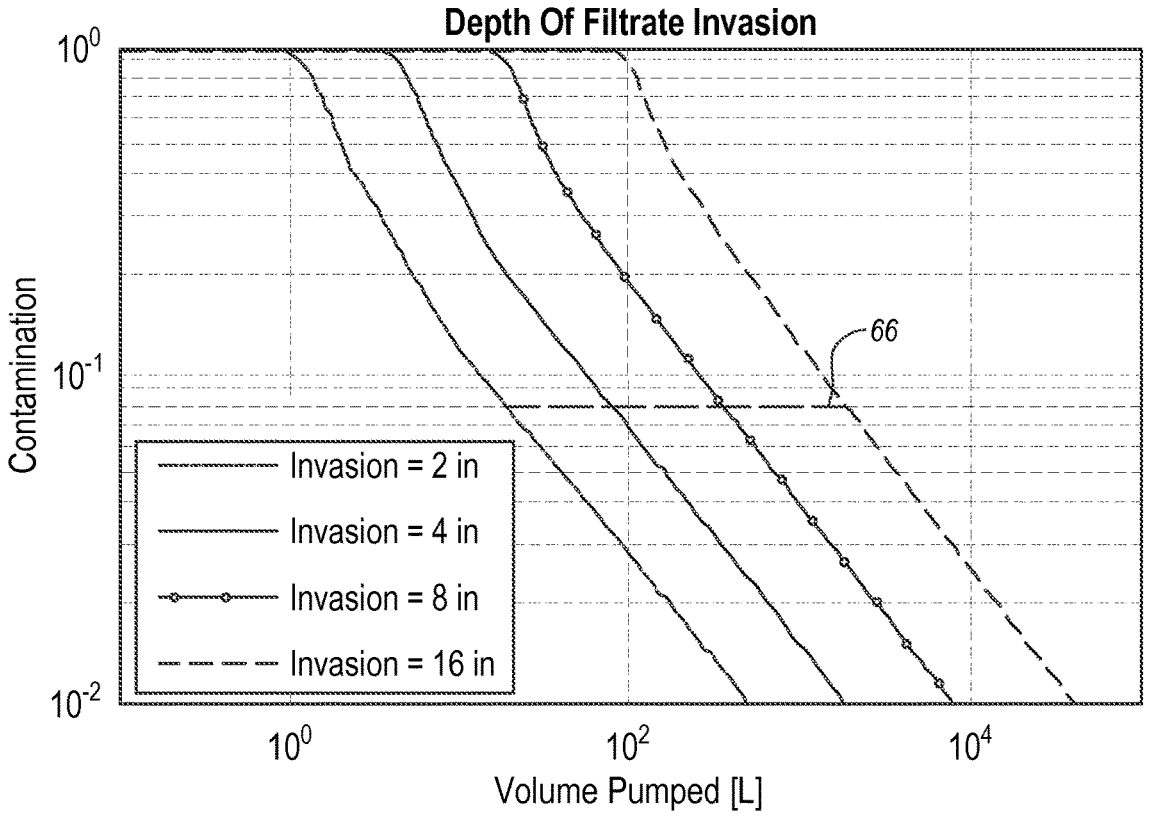
Figures 2, 7:
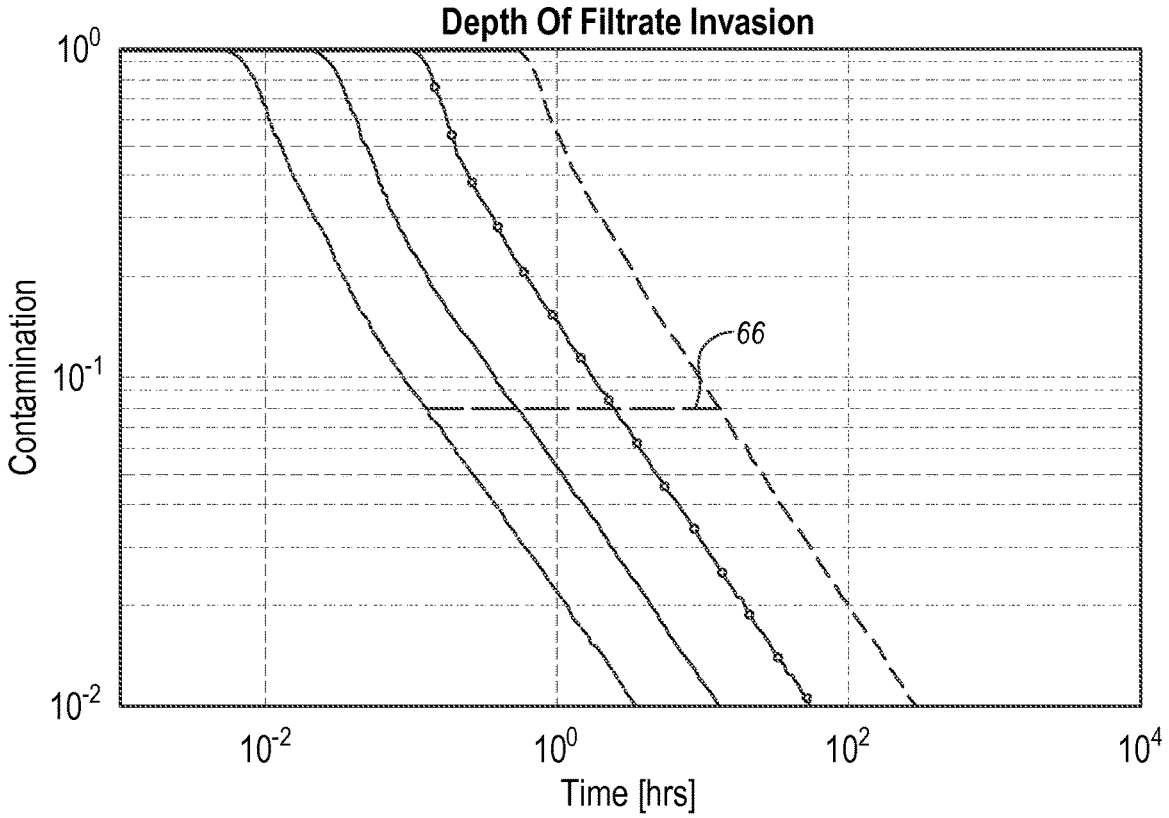

FIGS. 4-1 through 7-2 depict a sensitivity study for a clean-up performance with a radial probe having multiple circumferentially disposed inlets. The sensitivity study includes changes in absolute permeability (FIGS. 4-1 and 4-2), permeability anisotropy (FIGS. 5-1 and 5-2), viscosity ratio (FIGS. 6-1 and 6-2), and depth of filtrate invasion (FIGS. 7-1 and 7-2). Similar to FIG. 3, each graph plots the volume pumped (in liters) and the time (in hours) on a horizontal logarithmic scale versus the contamination ratio on a vertical logarithmic scale. In each case, the developed flow trend is proportional to $V^{-2/3}$, but the transition to the third flow regime 58 with developed flow exhibiting the two-thirds power law happens at a different time. Furthermore, as is visible in FIGS. 4-1 through 7-2, the three flow regimes are present irrespective of changes to the aforementioned conditions. The horizontal portion of the plot in the upper-left of each graph reflects the first flow regime 54 in which only filtrate is produced. The plots each, thereafter, enter the second flow 56 regime. The second flow regime 56 manifests differently for each of the conditions simulated. The second flow regime 56 may therefore present challenges in identifying the moment developed flow establishes and the flow enters the third flow regime 58. However, the third flow regime 58 is proportional to $V^{-2/3}$ (or $t^{-2/3}$) in each case.

Figures 1, 4:
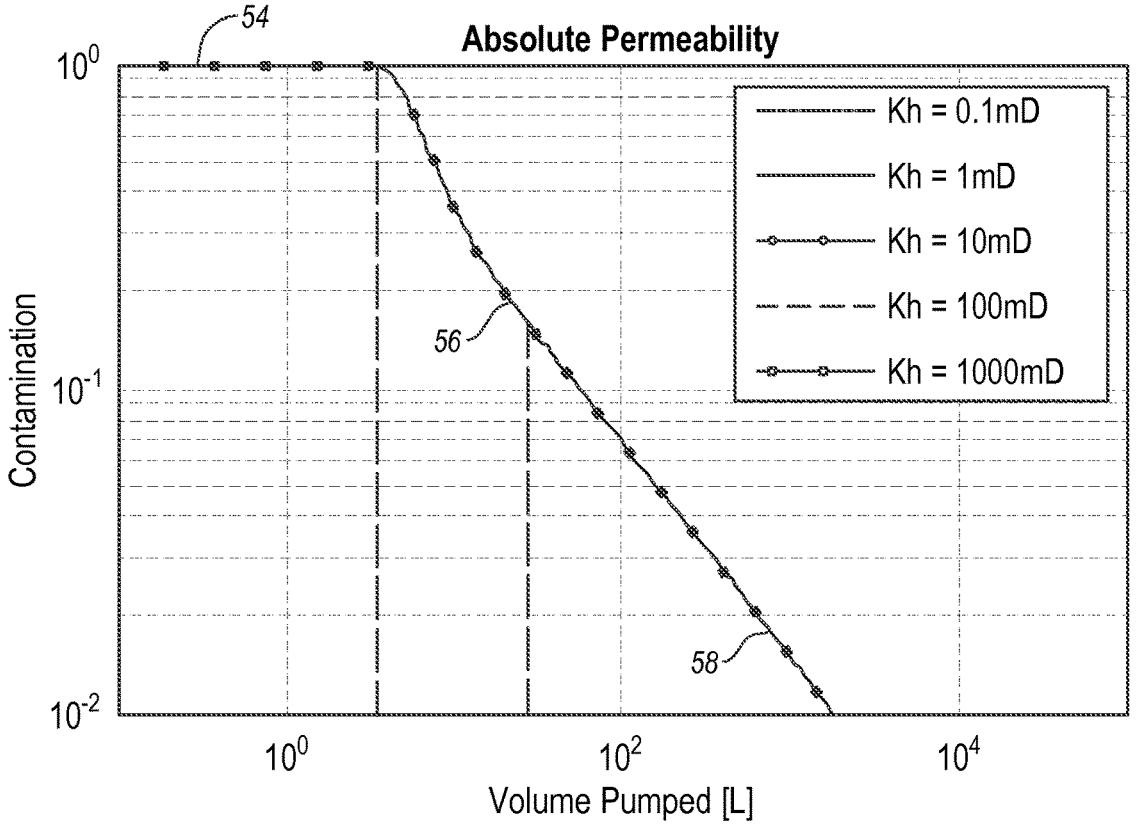
Figures 2, 4:
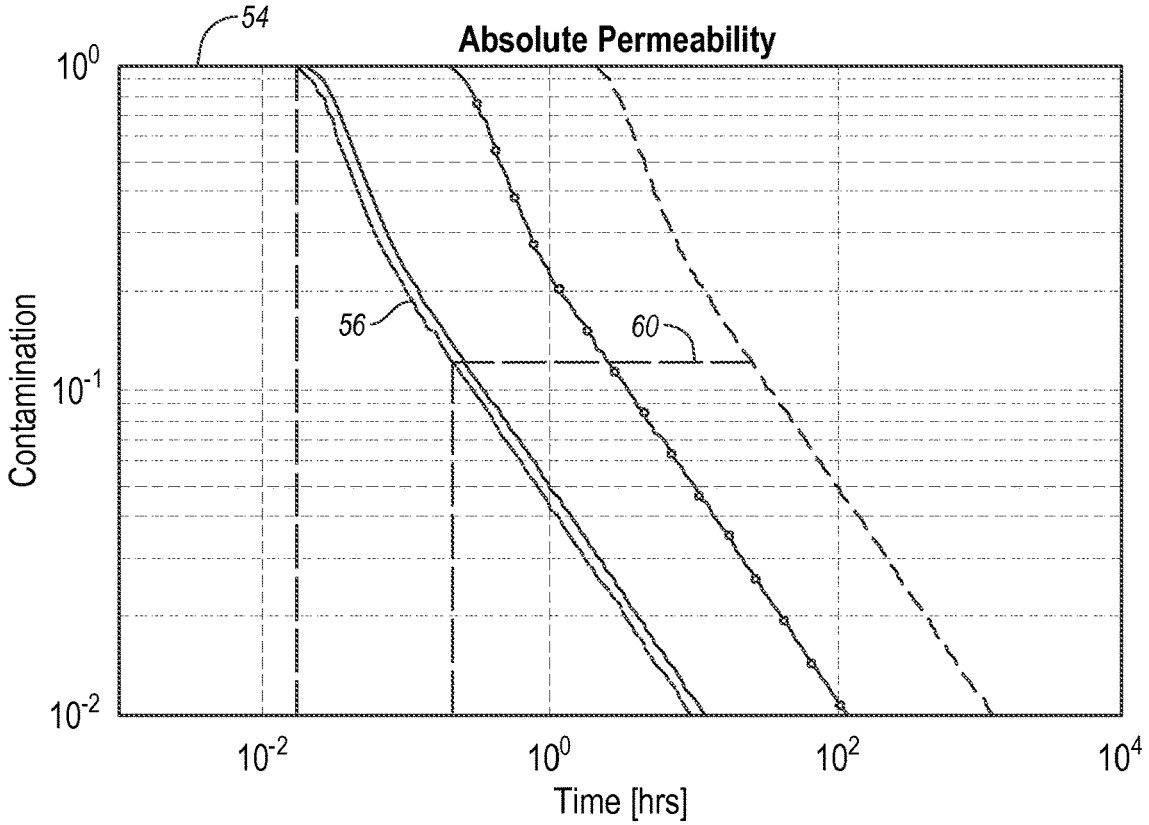

FIGS. 4-1 and 4-2 depict a sensitivity study for absolute permeability. FIG. 4-1 depicts a simulated contamination clean-up plot based on the volume of fluid pumped from the borehole and surrounding formation. Varying the absolute permeability of the formation alters the rate at which fluid moves through the formation, therefore, for all variations of the absolute permeability, the clean-up plot follows the same volume of fluid pumped. However, the time necessary to pump the same volume at each selected absolute permeability changes proportionately to the absolute permeability. This proportional increase in time is reflected in FIG. 4-2. The curves are similar, but each curve is spaced apart due to variations in the flow rate for each selected absolute permeability value. Developed flow establishes at approximately the same volume pumped 60 for each selected absolute permeability value, but involves proportionately more time as the absolute permeability decreases.

Figures 1, 5:
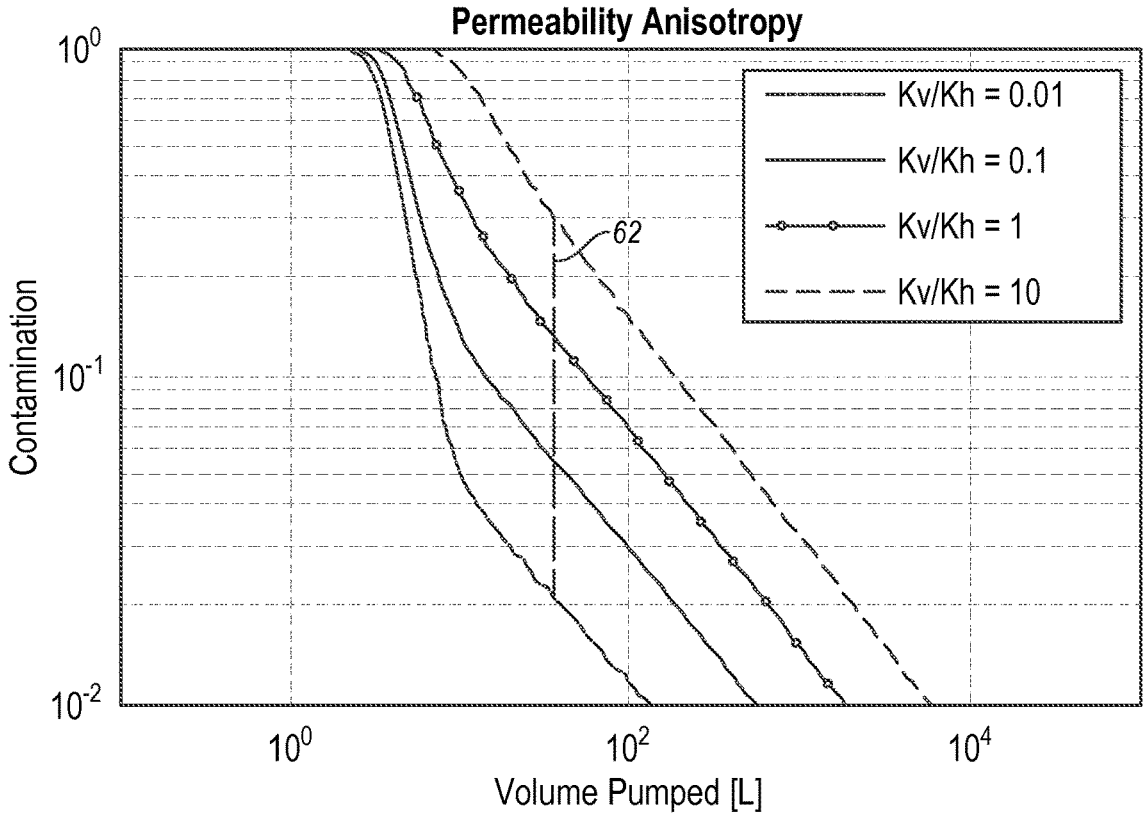
Figures 2, 5:
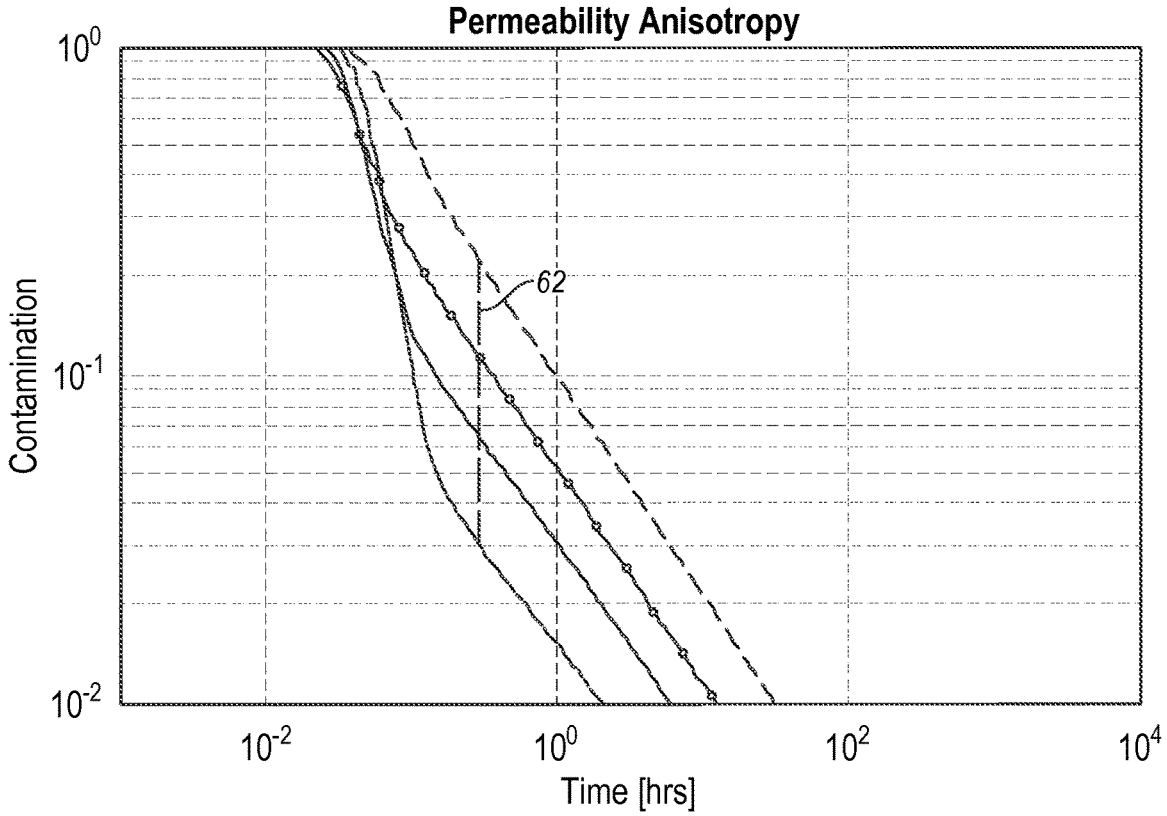

FIGS. 5-1 and 5-2 depict a sensitivity study for permeability anisotropy. Similarly to the absolute permeability sensitivity study of FIGS. 4-1 and 4-2, the developed third flow regime 58 establishes after an intermediate second flow regime 56 and is proportional to $t^{-2/3}$ (or $V^{-2/3}$). However, in contrast to FIGS. 4-1 and 4-2, the developed flow establishes at similar volumes pumped 62, which corresponds to a similar point in time 62 at each selected permeability anisotropy value. The second flow regime 56 correlates to the circumferential clean-up where filtrate is drawn from around the wellbore circumference at the level of the sampling device. The anisotropy of the permeability alters the path of the developed flow through the formation. The third flow regime 58, again, displays the same proportionality to $t^{-2/3}$ (or $V^{-2/3}$).

FIGS. 6-1 and 6-2 depict the clean-up rates of selected values for a viscosity ratio, or viscosity contrast, between the formation fluid and the drilling fluid. Flow in a mixture will favor a fluid with lower viscosity than a fluid with high viscosity. Therefore, the rate at which a contaminant is preferentially pumped from a system may change with changes in the viscosity ratio. The time and pump out volume both increase with an increase in the viscosity ratio, and, in contrast to altering the absolute permeability and permeability anisotropy, an increase in the viscosity ratios results in an increase time and pump out volume before establishing developed flow in the third flow regime 58. However, in each simulation, the transition point 64 at which each system establishes developed flow correlating to the −⅔ power law function occurs at a similar contamination, although the particular contamination ratio involves different volume or time to achieve.

Similarly, the depth of filtrate invasion also affects the time and pump out volume to establish developed flow. FIGS. 7-1 and 7-2 depict the simulated clean-up plots for selected filtrate invasion depths. The time and pump out volumes needed to reach transition point 66 and establish developed flow increase as the depth of the filtrate invasion into the surrounding formation increases. The clean-up plots of FIGS. 7-1 and 7-2 exhibit similar curves for each of the invasion depths. A significant difference between each of the clean-up plots is the time and pump out volume necessary to transition from the first flow regime to the second flow regime.

Both the depth of the filtrate invasion and the viscosity ratio between the formation fluid and drilling fluid alter the time or pump out volume at which developed flow establishes without significantly altering the percentage of the contaminant removed prior to the establishment of developed flow. In contrast, the absolute permeability alters the time at which the developed flow establishes, and the permeability anisotropy alters the percentage of the contaminant removed prior to establishing developed flow. In each situation, however, the clean-up rate of the third flow regime is proportional to $t^{-2/3}$ (or $V^{-2/3}$).

The power law of the third flow regime may allow the extrapolation of a property such as optical density, saturation pressure, gas-oil ratio, compressibility, conductivity, density, and the like. As can be seen in FIG. 3, the cleanup plot A establishes a linear behavior in the third flow regime 58 at approximately 20 minutes. However, a full cleanup of the system would involve approximately 9 hours of cleanup to achieve a 1% contamination. Therefore, formation fluid properties may be calculated earlier in a cleanup process if a start of a third flow regime 58 can be properly identified and a cleanup plot properly modeled. For example, during cleanup, optical density may be selected as the measured property and optical density can be fit by the following power function:

$$OD=\alpha+\beta V^{\gamma} \tag{1}$$

where OD is the modeled optical density, V is the pump out volume (can be replaced by time t), and α, β and γ are three adjustable parameters. Additionally, γ has been empirically shown to range from about −⅓ to about −⅔ for developed flow, which may depend on the type of probe employed. In an embodiment, the value of γ is approximately −⅔ when employing a radial probe. The values of α and β are obtained by fitting the modeled data to the measured data. The values of α and β that may provide a correlation within a predetermined tolerance between the modeled and measured data are carried forward for the extrapolation. As the pump out volume increases, the value of $V^{-2/3}$ will begin to approach zero, therefore, at infinite pump out volume (or time), the modeled optical density (OD) will be that of the uncontaminated formation fluid optical density ($OD_{Oil}$). Therefore, the value of a, obtained from extrapolating volume to infinity, must be the value of the formation fluid optical density ($OD_{Oil}$).

The ratio of contaminant to clean formation fluid can be calculated using Beer-Lambert's mixing rule:

$$OD=\eta OD_{filtrate}+(1-\eta)OD_{Oil} \tag{2}$$

which may be rewritten as:

$$\eta = \frac{OD_{Oil} - OD}{OD_{Oil} - OD_{filtrate}} \tag{3}$$

in which OD can be either the optical density as measured by DFA or the optical density modeled by equation 1. $OD_{filtrate}$ is a measured, calculated or known value. The filtrate optical density may be measured directly downhole, may be measured at surface conditions and corrected to attain the proper density at the appropriate depth, or calculated by other methods. Further, taking the log of Equation (1) and reordering the equation provides:

$$\text{Log}|OD-\alpha|=\text{Log}(\beta V^{\gamma}) \tag{4}$$

which may be rewritten as:

$$\text{Log}|OD-\alpha|=\gamma\ \text{Log}(V)+\text{Log}\ \beta \tag{5}$$

From equation (5), when the measured optical density behavior satisfies Equation (1), there is a linear relation between the Log of the absolute value of $OD-OD_{Oil}$ and the Log of V, where OD is the measured optical density, $OD_{Oil}$ is the optical density extrapolated from fitting equation 1 to optical density data (defining $\alpha=OD_{Oil}$) and V is the pump out volume. In other words, the flow has entered the developed flow of the third flow regime when the rate of change of the log of the difference between the measured optical density and the formation fluid optical density is linearly correlated to the rate of change of the product of the exponent and the log of the pump out volume. As stated earlier, as the pump out volume increases, the measured optical density may approach that of the pure formation fluid.

When the plot of the Log of the absolute value of $OD-OD_{Oil}$ versus the Log of V exhibits linear behavior, the measured optical density data satisfies constant power law behavior. When the measured data does not form a straight line, the power law is changing. Therefore, the clean-up is still in the second flow regime and has not yet established developed flow.

Figure 8:
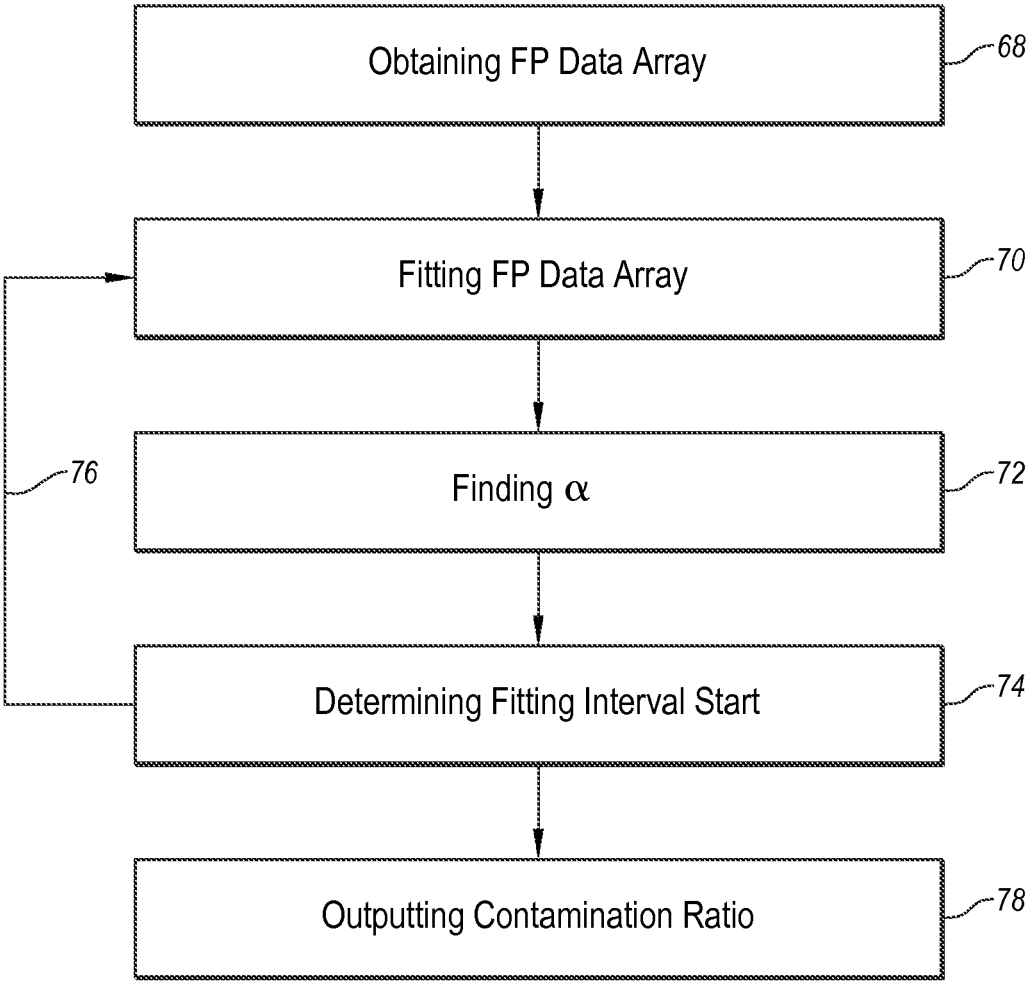
FIG. 8 is a flowchart depicting a method in accordance with one or more embodiments of the present disclosure.
Figure 9:
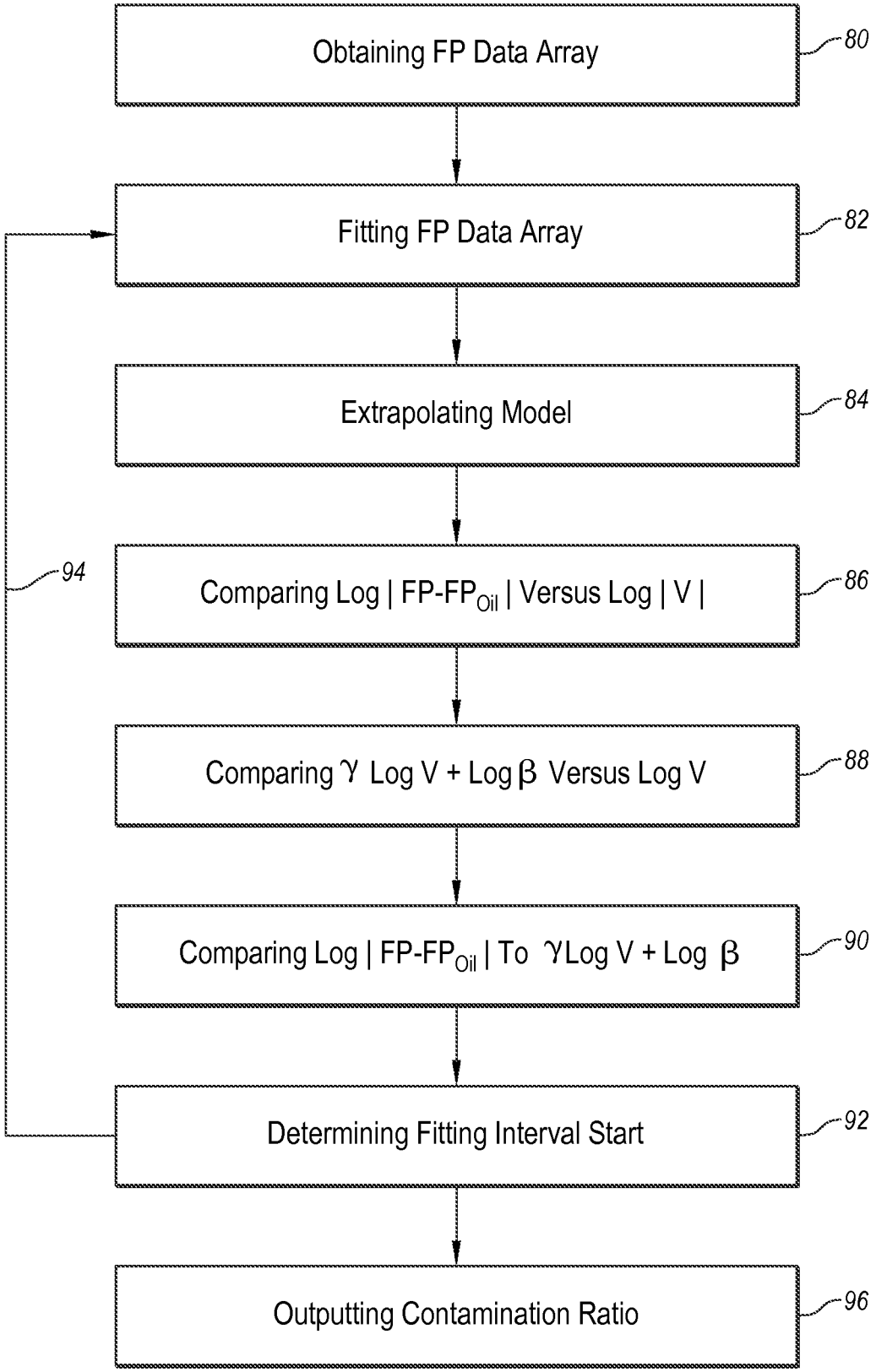
FIG. 9 is a flowchart depicting a another method in accordance with one or more embodiments of the present disclosure.
Figure 10:
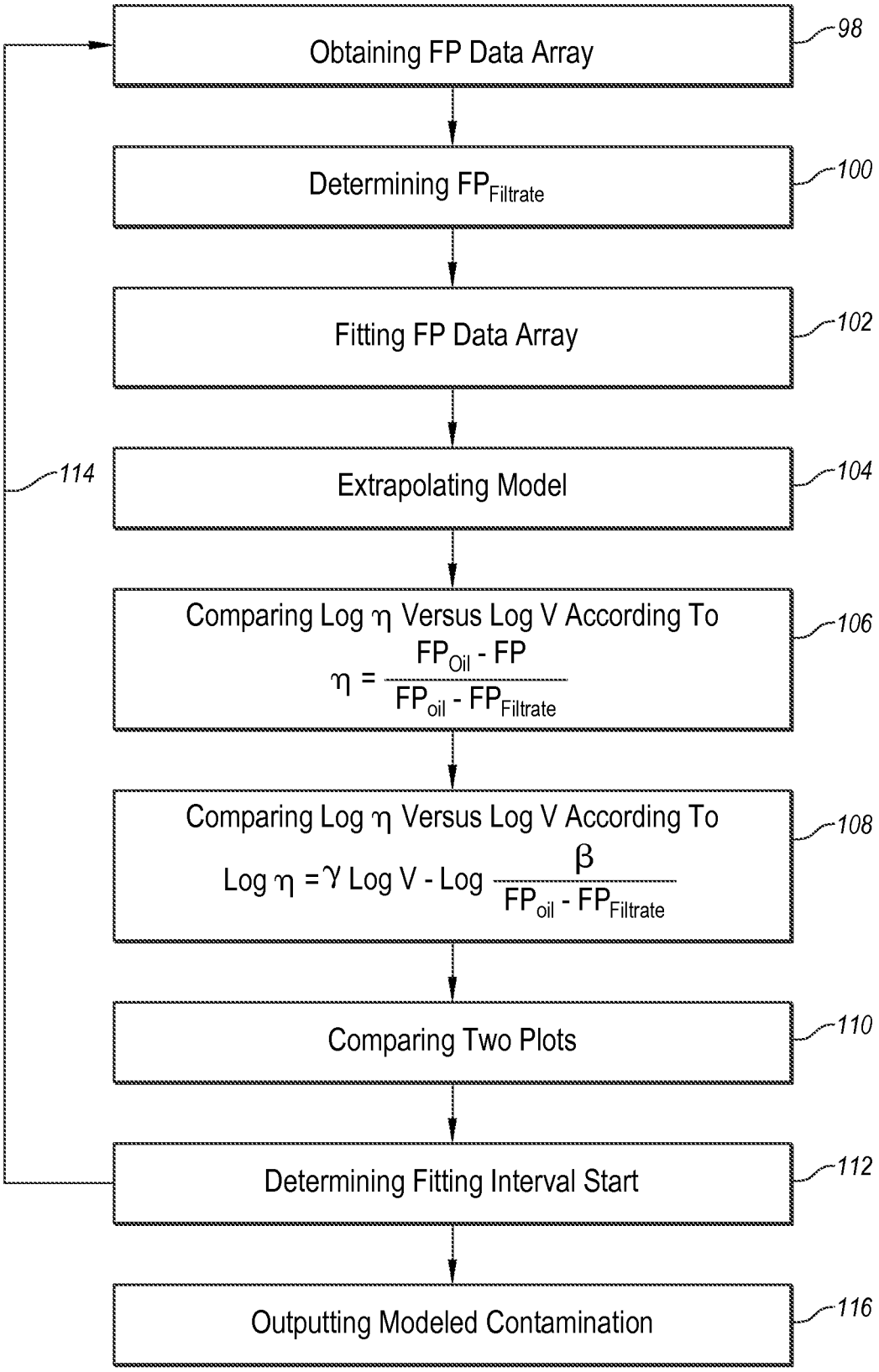
FIG. 10 is a flowchart depicting a yet another method in accordance with one or more embodiments of the present disclosure.

In view of the systems and architectures described above, methodologies that may be implemented in accordance with the disclosed subject matter will be better appreciated with reference to the flow charts of FIGS. 8, 9, and 10. For purposes of simplicity of explanation, the methodologies are shown and described as a series of blocks. However, it should be understood and appreciated that the claimed subject matter is not limited by the order of the blocks, as some blocks may occur in different orders and/or concurrently with other blocks from what is depicted and described herein. Moreover, not all illustrated blocks may be used to implement the methodologies described hereinafter.

Accordingly, the present disclosure includes a method, depicted in FIG. 8, for identifying the establishment of developed flow, fitting the appropriate power law function, and extrapolating measured properties to provide estimates of clean fluid properties. In an embodiment, the method may include obtaining a measured data array including at least a sample fluid parameter (FP) (e.g. optical density, gas-oil ratio, conductivity, density, compressibility, and other properties measurable through DFA as discussed above in connection with FIG. 1) and a durational value (D) (68) and fitting a model to the measured data array, the power law function having a predefined exponent value (70). The durational value (D) may be a time value (t), a volume pumped (V), or other parameter appropriate for measuring the duration of the cleanup. The model may then be extrapolated to obtain a value of a constant, such as $\alpha$ (72). The value of the constant may be applied to the power law function. Applying $\alpha$ to the power law function when the durational value equals infinity results in $\alpha$ being equal to the fluid parameter of the formation fluid, such as $FP_{Oil}$ and in circumstances when the fluid parameter is optical density $\alpha$ equals $OD_{Oil}$. $\alpha$ may also be applied to the power law function to obtain a value of $\beta$. When values for each adjustable parameter are known, the power law function and measured data array may be used to determine a fitting interval start (74) that defines the start of the third flow regime. The fitting interval start may be tested and confirmed or recalculated, such as by repeating the foregoing acts (76). The contamination ratio may then be output (78), such as with Beer-Lambert's mixing law shown in equation 3. In some embodiments the contamination ratio is plotted, such as on a graph or presented on a display.

In another embodiment, as depicted in FIG. 9, a method is provided for identifying the establishment of developed flow, fitting the appropriate power law function, and extrapolating measured properties to provide estimates of clean formation fluid properties. More specifically, a method for extrapolating uncontaminated formation fluid property values from property values measured from a contaminated sample fluid may include obtaining a measured data array including at least a sample fluid parameter (FP) and a durational value (D) (80). The sample fluid parameters (FP) of the measured data array may include optical density, gas-oil ratio, conductivity, density, compressibility, and other properties measurable through DFA as discussed above in connection with FIG. 1. A model may be fitted to the measured data array where the model is defined by a power law function proportional to $V^{-2/3}$ (or, alternatively, $t^{-2/3}$) (82). Once the model is fitted to the measured data array, the model is extrapolated to infinite volume pumped out to obtain a value of the formation fluid parameter ($FP_{Oil}$) (84).

Using the formation fluid value ($FP_{Oil}$) obtained from the previous fitting, $\text{Log}|FP-FP_{Oil}|$ versus Log V may be plotted (86). Thereafter, ($\gamma$ Log V+Log $\beta$), where $\gamma=-2/3$, versus Log V may be plotted on the same graph as $\text{Log}|FP-FP_{Oil}|$ versus Log V (88). $\text{Log}|FP-FP_{Oil}|$ may then be compared to ($\gamma$ Log V+Log $\beta$) (90). While the present disclosure refers to the comparison of values or equations by comparing plots of each, it should be understood that the comparison of values or equations may be accomplished by calculation, plotting, or any suitable mechanism. Furthermore, the term "plotting" as used herein is used broadly to refer to the comparison of data arrays and models whether displayed graphically or not. A fitting interval start may be determined by determining when the values of $\text{Log}|FP-FP_{Oil}|$ and ($\gamma$ Log V+Log $\beta$) overlay one another (92). As used herein, the term "overlay" means equal or within a predetermined tolerance. The foregoing acts may be repeated to ensure that the fitting interval start coincides with the point determined in the prior act (94). The contamination (according to $\eta=(FP_{Oil}-FP)/(FP_{Oil}-FP_{filtrate})$) may then be plotted (96). In some embodiments the contamination ratio is plotted, such as on a graph or presented on a display.

In addition to the foregoing, criteria may be added to aid in determining whether developed flow has been established. In one embodiment, when the sampling is conducted with a sampling tool having multiple ports, a start of the third flow regime may be after an inflection point has occurred in the plot when considered on log-log scales. In another embodiment, a start of the third flow regime may be after contamination is less than about 30%. Furthermore, the robustness of the fit may be tested by changing the fitting interval start volume and ensuring a remains within a predetermined tolerance. In an embodiment, the robustness of the fit may be tested by increasing the fitting interval start volume. The sensitivity of the fit to a change in the fitting start volume will decrease, as the quality of the fit improves. For example, a correct fit may be insensitive to changes in fitting interval start volume. In an embodiment, a may change by less than about 5% and remain in the predetermined tolerance. In another embodiment, a may change by less than about 1% and remain in the predetermined tolerance. In yet another embodiment, a may change by less than about 0.5% and remain in the predetermined tolerance.

In some embodiments, developed flow may be determined and end conditions of the fluid clean-up may be calculated by combining equations (1) and (3). Doing so provides:

$$\eta = \frac{OD_{Oil} - \alpha - \beta V^{\gamma}}{OD_{Oil} - OD_{Filtrate}} \tag{6}$$

Equation 6 describes the contamination ratio $\eta$ by applying Beer-Lambert's mixing law and defining the modeled optical density at any given pump out volume in terms of the known power law function described in Equation 1. Furthermore, when the extrapolated pump out volume approaches infinite volume the fluid is uncontaminated and $\alpha=OD_{Oil}$, therefore, Equation 6 further reduces to:

$$\eta = \frac{-\beta V^{\gamma}}{OD_{Oil} - OD_{filtrate}} \tag{7}$$

where $\gamma=-2/3$.

Upon taking the Log of Equation (7), the equation may be defined as $$\text{Log}\eta = -\text{Log}(V^{\gamma}) - \text{Log}\frac{\beta}{OD_{Oil} - OD_{filtrate}} \tag{8}$$

and finally, $$\text{Log}\eta = -\gamma\text{Log}V - \text{Log}\frac{\beta}{OD_{Oil} - OD_{filtrate}}. \tag{9}$$

Equation 9 demonstrates an additional method to produce a linear relationship between $\text{Log}|\eta|$ (the Log of the contamination ratio of drilling fluid to formation fluid) and Log V (the Log of a volume pumped), where the value of $\gamma$, again, becomes the slope of the logarithmic relationship.

Accordingly, the present disclosure includes another method, shown in FIG. 10, for determining and plotting a linear relationship between the Log of a volume pumped and the Log of the contamination ratio of drilling fluid to formation fluid. As shown in FIG. 10, the method may include obtaining a measured data array including at least a sample fluid parameter (FP) and a durational value (D) (98). As noted elsewhere herein, the measured value may include optical density, saturation pressure, gas-oil ratio, compressibility, conductivity, density, and the like. The fluid parameter of the filtrate $FP_{filtrate}$ is also determined (100). A model defined by a power law function proportional to $V^{-2/3}$ (or, alternatively, $t^{-2/3}$) is fitted to the measured data array (102). Thereafter, the model is extrapolated to infinite volume pumped out to obtain a value of the formation fluid ($FP_{Oil}$) (104).

A first plot of Log|η| versus Log V using equation 3, where OD is equal to the measured optical density, is plotted a on a graph (106). Likewise, a second plot of Log|η| versus Log V according to equation 9 using the same $OD_{Oil}$ and $OD_{filtrate}$ is plotted on the same graph (108). A comparison is made between the first and second plots on the graph (110) in order to determine whether the first and second plots overlay (112). The point where the curves overlay may coincide with the start of a logarithmic trend of the contamination calculated from measured data. The previous acts may be repeated to ensure that the fitting interval start coincides with the point determined in the prior act (114). The contamination (according to $\eta=(FP_{Oil}-FP)/(FP_{Oil}-FP_{filtrate})$) may then be plotted on a linear scale (116).

In addition to the foregoing, criteria may be added to aid in determining whether developed flow has been established. In one embodiment, when the sampling is conducted with a sampling tool having multiple ports, a start of the third flow regime may be after an inflection point has occurred in the plot when considered on log-log scales. In another embodiment, a start of the third flow regime may be after contamination is less than about 30%. Furthermore, the robustness of the fit may be tested by changing the fitting interval start volume and ensuring a remains within a predetermined tolerance. In an embodiment, the robustness of the fit may be tested by increasing the fitting interval start volume. The sensitivity of the fit to a change in the fitting start volume will decrease as the quality of the fit improves. For example, a correct fit may be insensitive to changes in fitting interval start volume. In an embodiment, a may change by less than about 5% and remain in the predetermined tolerance. In another embodiment, a may change by less than about 1% and remain in the predetermined tolerance. In yet another embodiment, a may change by less than about 0.5% and remain in the predetermined tolerance.

Figure 11:
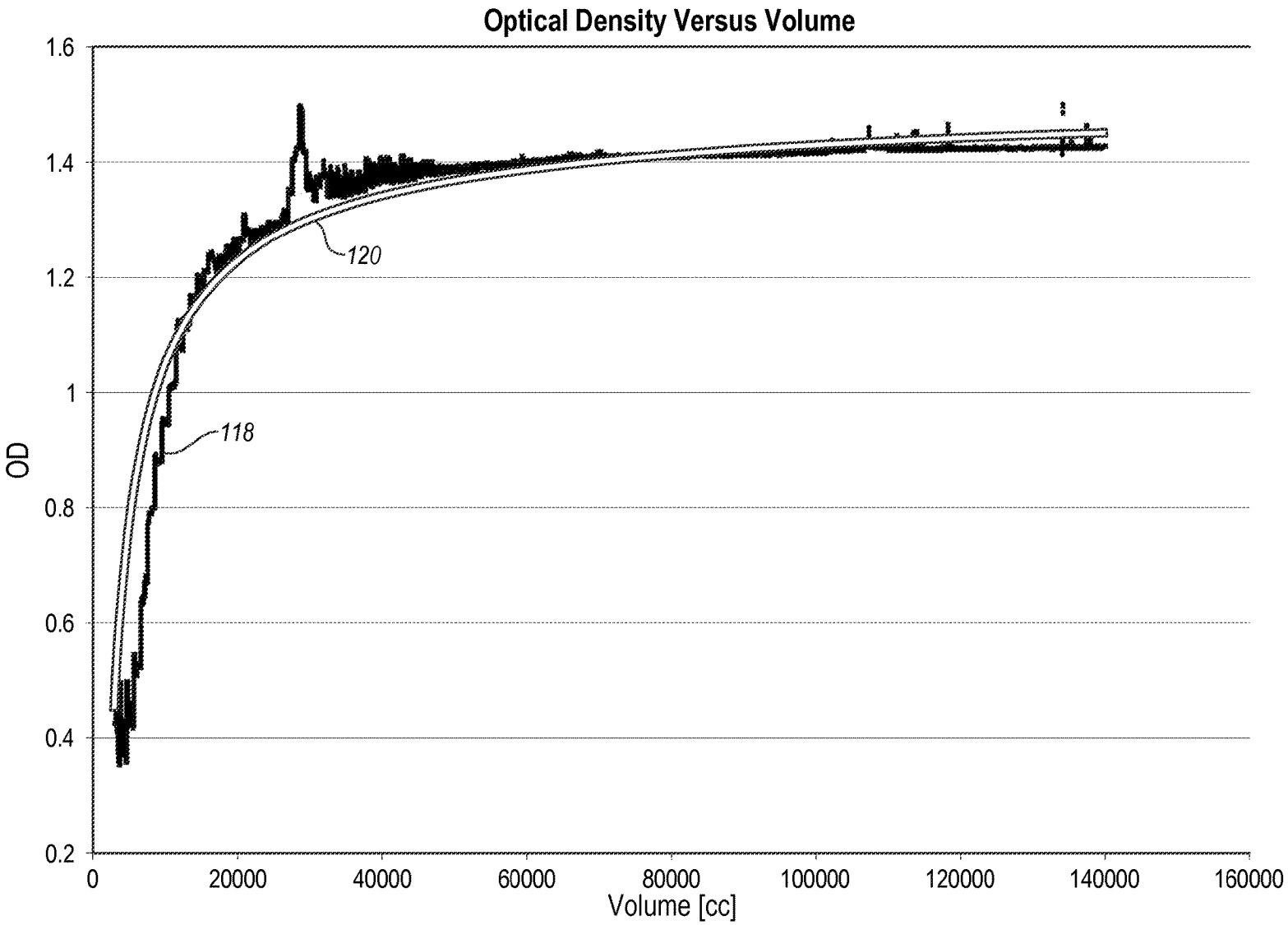
FIG. 11 depicts a graph showing an increase in optical density as measured during well cleanup.
Figure 12:
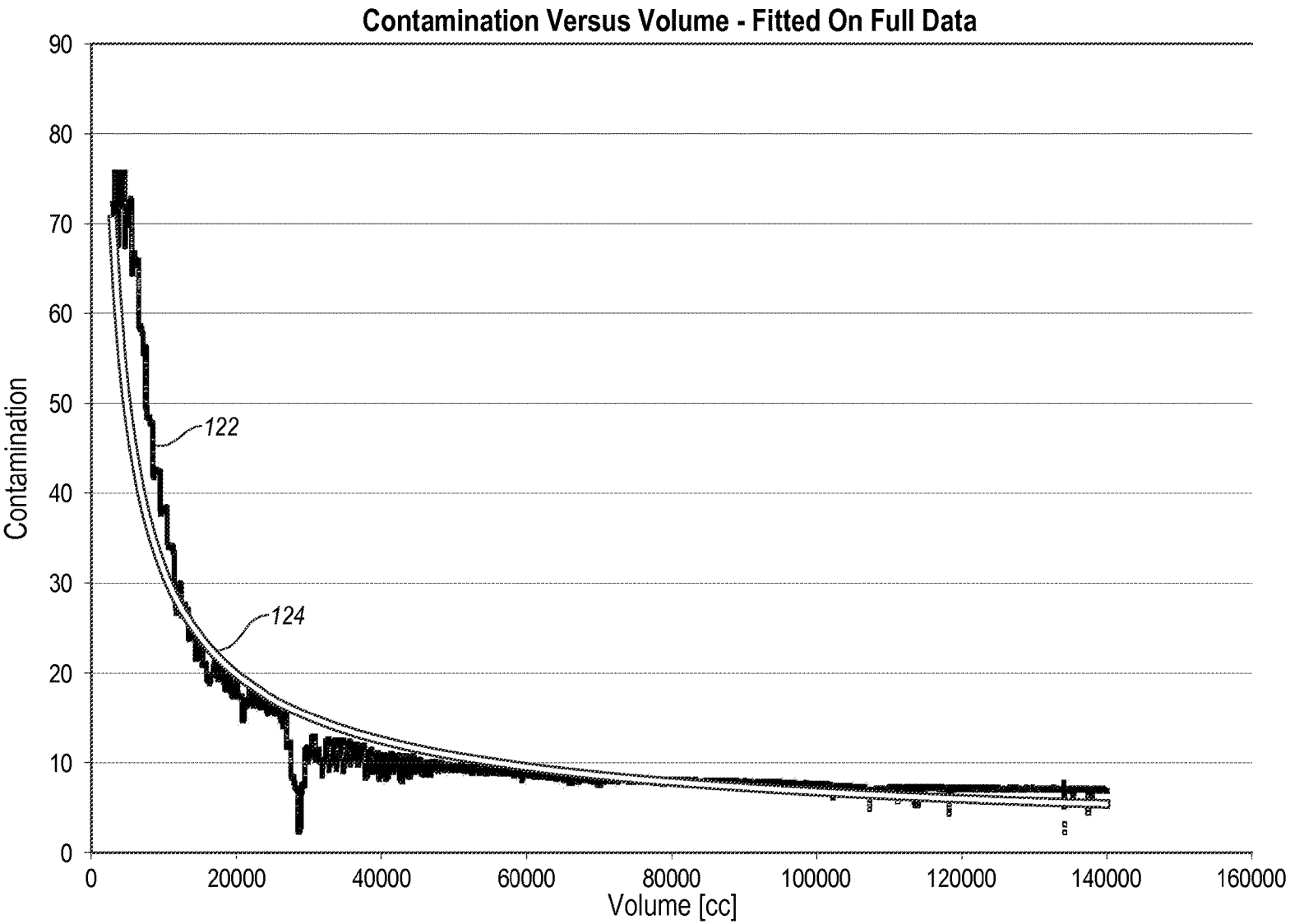
FIG. 12 depicts a graph reflecting an improper fitting of a power law function of the data of FIG. 11 based on a full cleanup plot.
Figure 13:
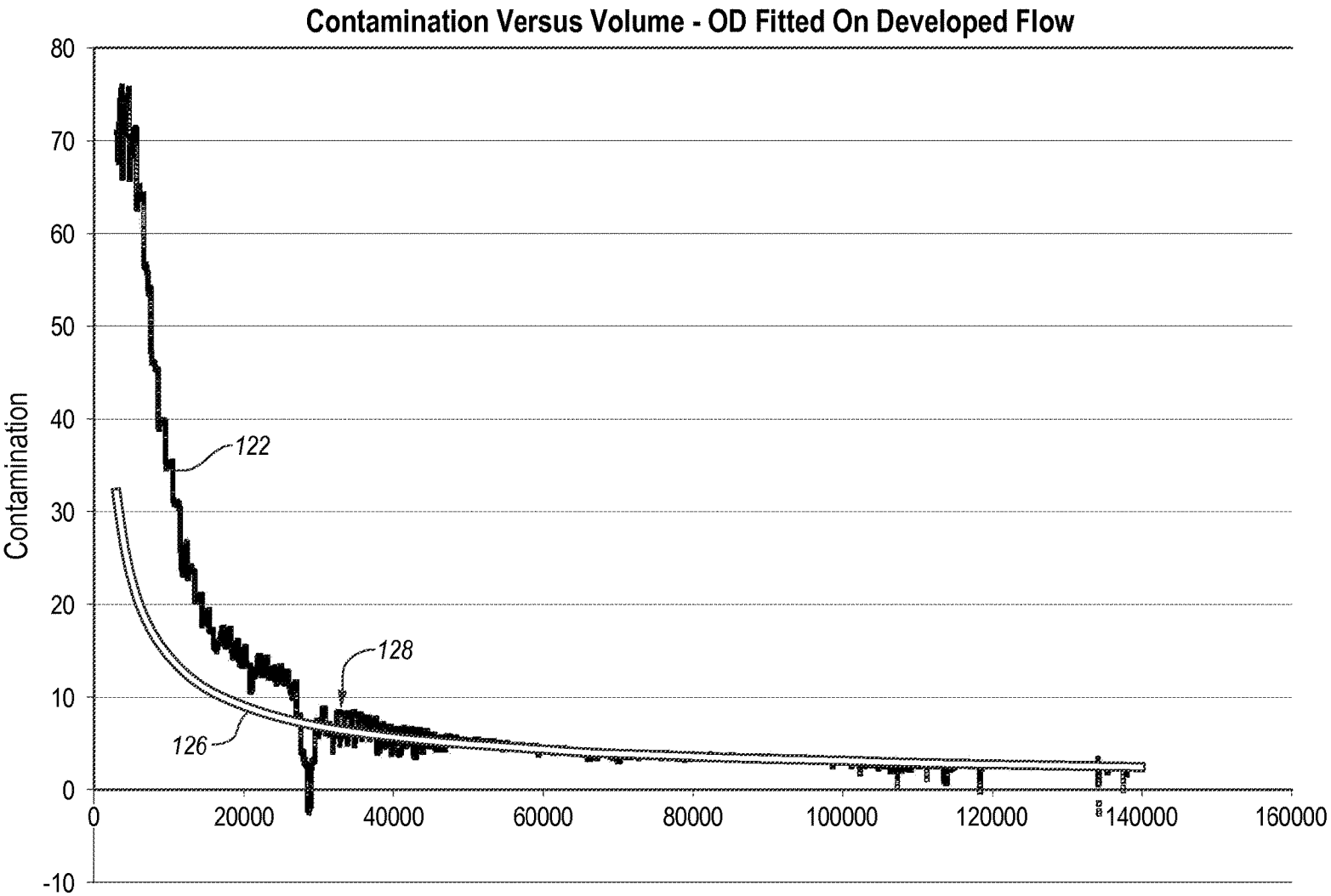
FIG. 13 depicts a graph reflecting a proper fitting of the data from FIG. 11 based on developed flow.

Such logarithmic behavior in a third flow regime during cleanup may be seen, for example, in FIGS. 11-15. FIG. 11 shows a plot of optical density data interval 118 collected during well cleanup. Attempting to fit a single logarithmic curve to the entire data interval 118 yields a poorly fit curve 120. Similarly, when the optical density is used to plot the contamination of the system versus volume pumped, as shown in FIG. 12, the contamination plot 122 reflects the previously described relationship between the optical density and the contamination. Attempting to fit a single logarithmic curve to the entire plot 122 yields a poorly fit curve 124. FIG. 13 shows a properly modeled curve 126 fit to the contamination plot 122 in accordance with the methods disclosed herein. Notably, the fitting start is not the start of the data interval 122, but rather at the start of the developed flow regime 128.

Figure 14:
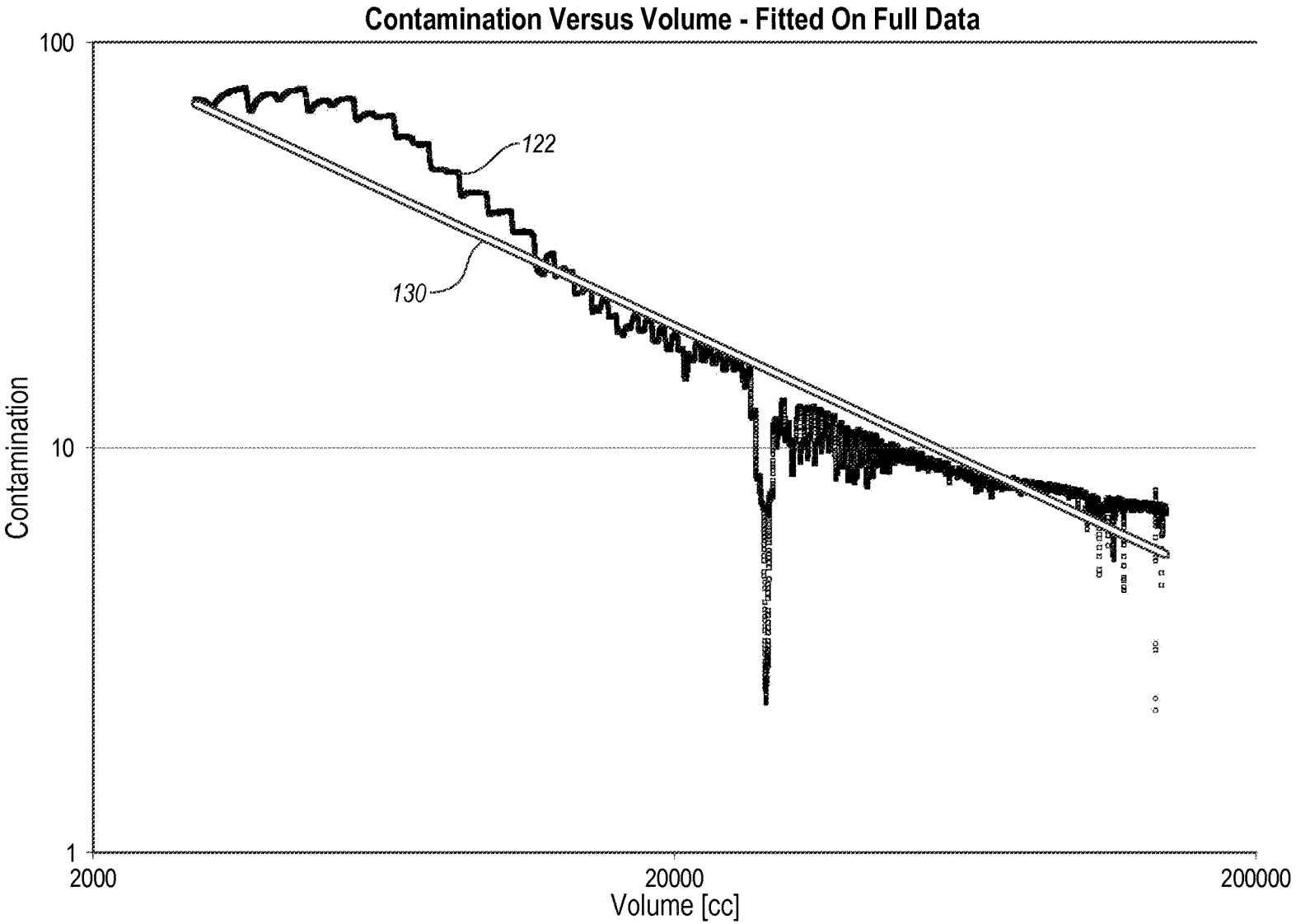
FIG. 14 depicts the data and improper fitting of FIG. 12 on a logarithmic scale.
Figure 15:
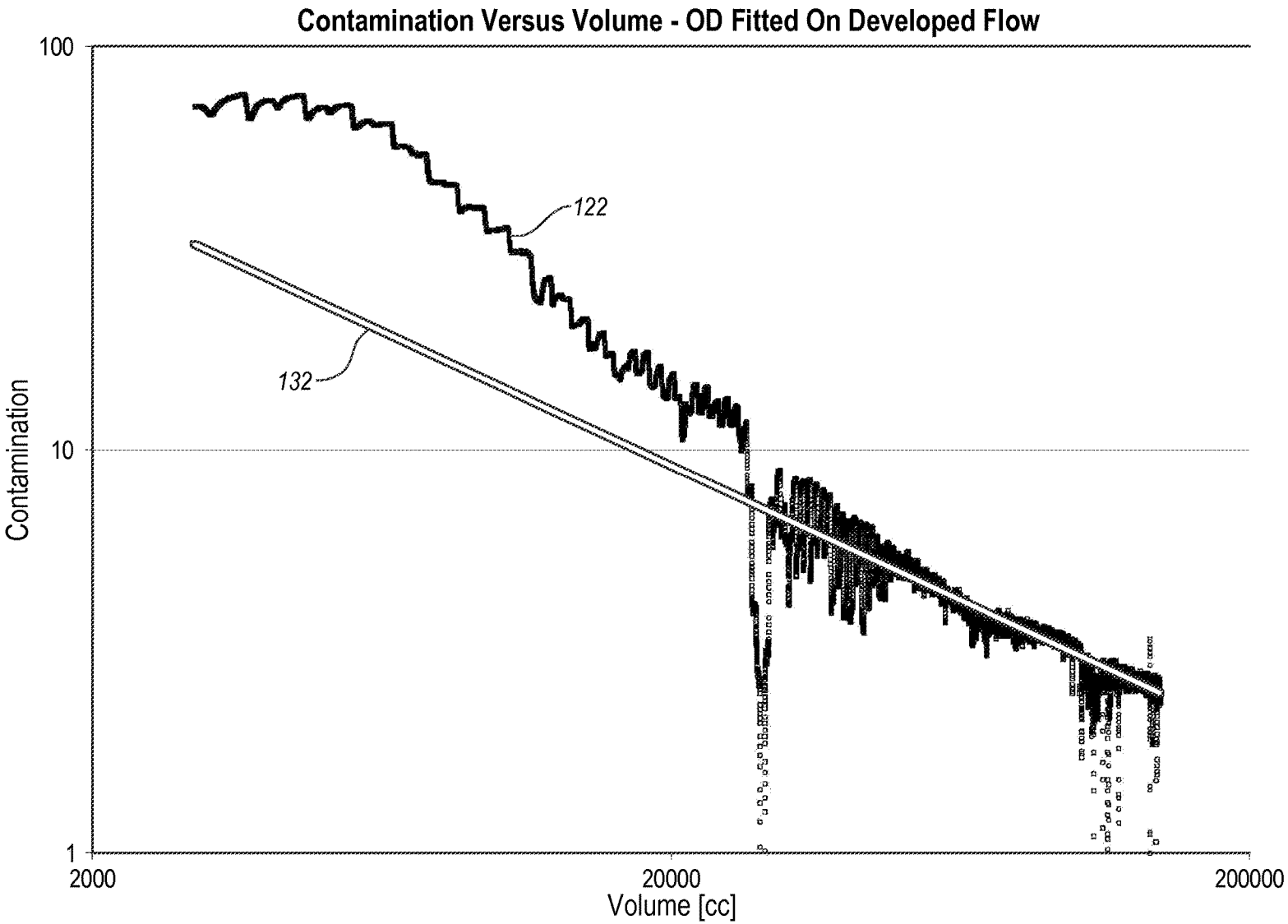
FIG. 15 depicts the data and proper fitting of FIG. 13 on a logarithmic scale.

Similarly, FIG. 14 shows a contamination plot 122 and a poorly fit line 130 when the optical density is used to plot the contamination of the system versus volume pumped on a logarithmic scale. The contamination plot reflects the relationship between the optical density and the contamination. On the logarithmic scale, the third flow regime will exhibit linear behavior. Attempting to fit a single logarithmic line to the entire plot 122, again, yields a poorly fit line 130. FIG. 15 shows a properly modeled line 132 fit to the contamination plot 122 in accordance with the methods disclosed herein. That is, the properly modeled line 132 is fit the developed flow regime portion of the plot 122.

Embodiments described herein may be implemented on various types of computing systems. These computing systems are now increasingly taking a wide variety of forms. Computing systems may, for example, be handheld devices, appliances, laptop computers, desktop computers, mainframes, distributed computing systems, or even devices that have not conventionally been considered a computing system. In this description and in the claims, the term "computing system" is defined broadly as including any device or system (or combination thereof) that includes at least one physical and tangible processor, and a physical and tangible memory capable of having thereon computer-executable instructions that may be executed by the processor. A computing system may be distributed over a network environment and may include multiple constituent computing systems.

As used herein, the term "executable module" or "executable component" can refer to software objects, routings, or methods that may be executed on the computing system. The different components, modules, engines, and services described herein may be implemented as objects or processes that execute on the computing system (e.g., as separate threads).

Figure 16:
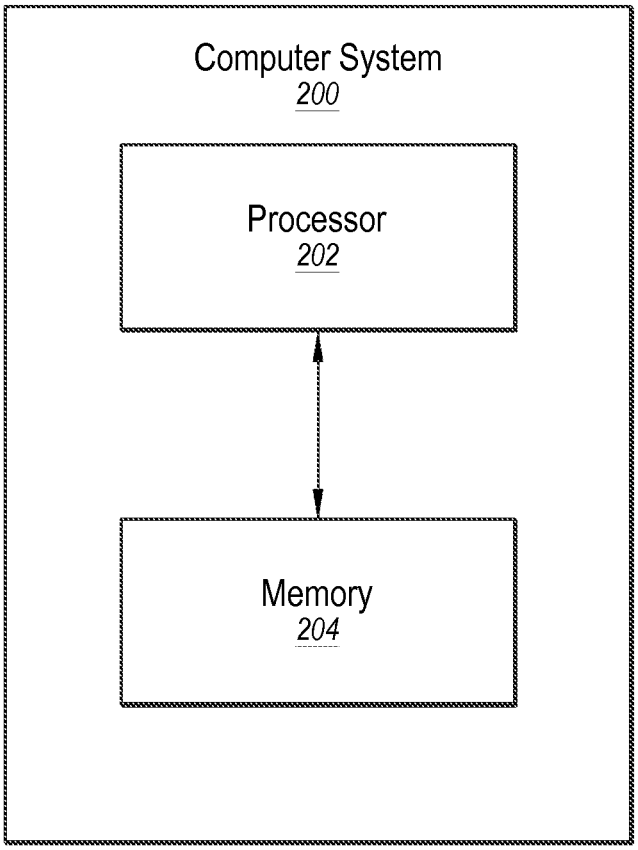
FIG. 16 depicts a computer system capable of performing methods in accordance with the present disclosure.

As illustrated in FIG. 16, a computing system 200 typically includes at least one processing unit 202 and memory 204. The memory 204 may be physical system memory, which may be volatile, non-volatile, or some combination of the two. The term "memory" may also be used herein to refer to non-volatile mass storage such as physical storage media. If the computing system is distributed, the processing, memory and/or storage capability may be distributed as well.

Embodiments of the methods described herein may be described with reference to acts that may be performed by one or more computing systems. If such acts are implemented in software, one or more processors of the associated computing system that performs the act direct the operation of the computing system in response to having executed computer-executable instructions. For example, such computer-executable instructions may be embodied on one or more computer-readable media that form a computer program product. An example of such an operation involves the manipulation of data. The computer-executable instructions (and the manipulated data) may be stored in the memory 204 of the computing system 200. Computing system 200 may also contain communication channels that allow the computing system 200 to communicate with other message processors over a wired or wireless network.

Embodiments described herein also include physical and other computer-readable media for carrying or storing computer-executable instructions and/or data structures. Such computer-readable media can be any available media that can be accessed by a general-purpose or special-purpose computer system. Computer-readable media that store computer-executable instructions and/or data structures are computer storage media. Computer-readable media that carry computer-executable instructions and/or data structures are transmission media. Thus, by way of example, and not limitation, embodiments described herein can comprise at least two distinctly different kinds of computer-readable media: computer storage media and transmission media.

Computer storage media are physical hardware storage media that store computer-executable instructions and/or data structures. Physical hardware storage media include computer hardware, such as RAM, ROM, EEPROM, solid state drives ("SSDs"), flash memory, phase-change memory ("PCM"), optical disk storage, magnetic disk storage or other magnetic storage devices, or any other hardware storage device(s) which can be used to store program code in the form of computer-executable instructions or data structures, which can be accessed and executed by a general-purpose or special-purpose computer system to implement the functionality disclosed herein.

Transmission media can include a network and/or data links which can be used to carry program code in the form of computer-executable instructions or data structures, and which can be accessed by a general-purpose or special-purpose computer system. A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer system, the computer system may view the connection as transmission media. Combinations of the above should also be included within the scope of computer-readable media.

Further, upon reaching various computer system components, program code in the form of computer-executable instructions or data structures can be transferred automatically from transmission media to computer storage media (or vice versa). For example, computer-executable instructions or data structures received over a network or data link can be buffered in RAM within a network interface module (e.g., a "NIC"), and then eventually transferred to computer system RAM and/or to less volatile computer storage media at a computer system. Thus, it should be understood that computer storage media can be included in computer system components that also (or even primarily) utilize transmission media.

Computer-executable instructions comprise, for example, instructions and data which, when executed at one or more processors, cause a general-purpose computer system, special-purpose computer system, or special-purpose processing device to perform a certain function or group of functions. Computer-executable instructions may be, for example, binaries, intermediate format instructions such as assembly language, or even source code.

The terms "approximately," "about," and "substantially" as used herein represent an amount close to the stated amount that still performs a desired function or achieves a desired result. For example, the terms "approximately," "about," and "substantially" may refer to an amount that is within less than 10% of, within less than 5% of, within less than 1% of, within less than 0.1% of, and within less than 0.01% of a stated amount.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

We claim:

1. A method for determining a contamination ratio of a formation fluid in a reservoir, the method comprising:

lowering a downhole sampling tool into a wellbore traversing the reservoir, obtaining a measured data array including at least a sample fluid parameter and a durational value via the downhole sampling tool by drawing sample fluid through a flowline that provides fluid communication between one or more inlets and an outlet and using a fluid analyzer operatively disposed in the downhole sampling tool;

in a processor coupled to the downhole sampling tool, fitting a model to the measured data array, the model being defined by a power law function containing the durational value;

in the processor, extrapolating the model according to the power law function when the durational value equals infinity to find a formation fluid parameter, wherein the power law function is $FP=\alpha+\beta*D^{\gamma}$, wherein FP is the sample fluid parameter, $\alpha$ is the formation fluid parameter, $\beta$ is a fitting constant, D is the durational value, and $\gamma$ is an exponent value;

in the processor, determining a fitting interval start point by determining when values of $\text{Log}|FP-\alpha|$ overlay values of ($\gamma$ Log V+Log $\beta$), wherein the durational value is volume (V);

in the processor, confirming the fitting interval start point overlays a linear portion of the measured data array when compared on log-log scales;

repeating said steps of obtaining, fitting, extrapolating, determining and confirming, to ensure consistency of the fitting interval start point; and outputting the contamination ratio based on the fitting interval start point for the formation fluid using Beer-Lambert's mixing law and plotting the contamination ratio for the formation fluid on a graph for presentation on a display.

2. The method of claim 1, wherein the sample fluid parameter is optical density, gas-oil-ratio, compressibility, density, or conductivity.

3. The method of claim 1, wherein obtaining the measured data array further comprises obtaining the measured data array using a radial probe.

4. The method of claim 1, wherein confirming the fitting interval start point comprises changing the fitting interval start point and verifying the formation fluid parameter remains within a predetermined tolerance.

5. The method of claim 1, wherein the power law function comprises the exponent value of $-2/3$.

6. The method of claim 1, wherein determining the fitting interval start point further comprises:

plotting on a plot the values of $\text{Log}|FP-\alpha|$ versus values of Log V;

plotting on the plot the values of ($\gamma$ Log V+Log $\beta$) versus the values of Log V;

comparing the values of $\text{Log}|FP-\alpha|$ to the values of ($\gamma$ Log V+Log $\beta$); and determining when the values of $\text{Log}|FP-\alpha|$ overlay the values of ($\gamma$ Log V+Log $\beta$).

7. The method of claim 1, wherein determining the fitting interval start point further comprises:

plotting on a graph a first plot of values of Log|η| versus values of Log V according to $\eta=(FP_{Oil}-FP)/(FP_{Oil}-FP_{Filtrate})$, wherein $FP_{Oil}$ is the formation fluid parameter and $FP_{Filtrate}$ is a fluid parameter of a filtrate in the sample fluid;

plotting on the graph a second plot of the values of Log|η| versus the values of Log V according to $\text{Log}|\eta|=-\gamma \text{ Log } V-\text{Log } [\beta/(FP_{Oil}-FP_{Filtrate})]$;

comparing the first and second plots on the graph; and determining whether the first and second plots overlay one another.

8. A method for determining a contamination ratio of a formation fluid in a reservoir, the method comprising:

lowering a downhole sampling tool into a wellbore traversing the reservoir, obtaining a measured data array including at least a sample fluid parameter (FP) and a durational value (D) via the downhole sampling tool by drawing sample fluid through a flowline that provides fluid communication between one or more inlets and an outlet and using a fluid analyzer operatively disposed in the downhole sampling tool);

in a processor coupled to the downhole sampling tool, fitting a model to the measured data array, wherein α is a formation fluid parameter and β is a fitting constant, the model being defined by a power law function:

$$FP=\alpha+\beta*D^{\gamma}$$

where γ is −⅔;

in the processor, extrapolating $FP=\alpha+\beta*D^{\gamma}$ when the durational value equals infinity to find α;

in the processor, determining a fitting interval start when values of Log|FP−α| and values of (γ Log D+Log β) remain within a predetermined tolerance;

in the processor, confirming the fitting interval start overlays a start of a linear portion of the measured data array when compared on log-log scales; and in the processor, outputting the contamination ratio based on the fitting interval start point for the formation fluid using Beer-Lambert's mixing law and plotting the contamination ratio for the formation fluid on a graph for presentation on a display.

9. The method of claim 8, wherein the sample fluid parameter is optical density, gas-oil ratio, compressibility, density, or conductivity.

10. The method of claim 8, wherein determining the fitting interval start when the values of Log|FP−α| and the values of (γ Log D+Log β) remain within the predetermined tolerance comprises measuring an inflection point in the values of (γ Log D+Log β) versus the values of Log|FP−α| when compared on log-log scales.

11. The method of claim 8, wherein determining the fitting interval start when the values of Log|FP−α| and the values of (γ Log D+Log β) remain within the predetermined tolerance comprises calculating the contamination ratio less than 30%.

12. The method of claim 8, further comprising confirming the fitting interval start by changing the fitting interval start and verifying the formation fluid parameter remains within the predetermined tolerance.

13. A computer program product for determining a contamination ratio of a formation fluid in a reservoir from contaminated fluid in a system, the computer program product comprising one or more non-transitory computer-readable storage media having stored thereon computer-executable instructions that, when executed by one or more processors of a computing system, cause the computing system to perform a method comprising:

accessing a measured data array including at least a sample fluid parameter and a durational value, said data array being measured by a downhole sampling tool lowered into a wellbore traversing the reservoir;

fitting a model to the measured data array, the model being defined by a power law function containing the durational value, wherein the power law function is $FP=\alpha+\beta*D^{\gamma}$, wherein FP is the sample fluid parameter, α is a formation fluid parameter, β is a fitting constant, D is the durational value, and γ is an exponent value;

extrapolating the model according to the power law function when the durational value equals infinity to find the formation fluid parameter;

determining a fitting interval start by determining when values of Log|FP−α| overlay values of (γ Log D+Log β); and confirming the fitting interval start overlays a linear portion of the measured data array when compared on log-log scales;

outputting the contamination ratio based on the fitting interval start for the formation fluid using Beer-Lambert's mixing law and plotting the contamination ratio for the formation fluid on a graph for presentation on a display.

14. The computer program product for implementing the method of claim 13, wherein determining the fitting interval start when the values of Log|FP−α| overlay the values of (γ Log D+Log β) comprises calculating the contamination ratio less than 30%.

15. The computer program product for implementing the method of claim 13, further comprising determining whether values of Log versus values of Log D according to $\eta=(FP_{Oil}-FP)/(FP_{Oil}-FP_{Filtrate})$, and the values of Log|η| versus the values of Log D according to $\text{Log}|\eta|=-\gamma \text{ Log } D-\text{Log } [\beta/(FP_{Oil}-FP_{Filtrate})]$ are within a predetermined tolerance of one another, wherein $FP_{Oil}$ is the value of the formation fluid parameter and $FP_{Filtrate}$ is a fluid parameter of a filtrate in the sample fluid.

* * * * *